US007642921B2

(12) United States Patent
Cutler et al.

(10) Patent No.: US 7,642,921 B2
(45) Date of Patent: Jan. 5, 2010

(54) ELECTRONIC SWIMMER MONITORING SYSTEM

(75) Inventors: David M. Cutler, Redding, CT (US); Douglas D. Sutton, Albuquerque, NM (US); Lawrence R. Miller, Redding, CT (US); Paul E. Taylor, Redding, CT (US); Thomas F. Healy, Redding, CT (US); Marlin J. Gregor, Tucson, AZ (US); William G. Taylor, Redding, CT (US)

(73) Assignee: Aquatic Safety Concepts, LLC, Redding, CT (US)

( * ) Notice: Subject to any disclaimer, the term of this patent is extended or adjusted under 35 U.S.C. 154(b) by 0 days.

(21) Appl. No.: 12/175,797

(22) Filed: Jul. 18, 2008

(65) Prior Publication Data

US 2009/0027211 A1 Jan. 29, 2009

Related U.S. Application Data

(60) Provisional application No. 60/951,243, filed on Jul. 23, 2007.

(51) Int. Cl.
*G08B 23/00* (2006.01)

(52) U.S. Cl. ..... 340/573.6; 340/573.1

(58) Field of Classification Search ..... 340/573.6, 340/573.1

See application file for complete search history.

(56) References Cited

U.S. PATENT DOCUMENTS 3,810,146 A * 5/1974 Lieb ..... 340/541
4,549,169 A * 10/1985 Moura et al. ..... 340/539.26
4,747,085 A * 5/1988 Dunegan et al. ..... 367/93
4,780,861 A * 10/1988 Stembridge et al. ..... 367/150
5,049,859 A * 9/1991 Arnell ..... 340/573.6
5,097,254 A 3/1992 Merrithew
5,138,300 A 8/1992 Chance
5,144,285 A * 9/1992 Gore ..... 340/573.6
5,185,605 A 2/1993 Roberts, Jr. et al.
5,241,923 A * 9/1993 Janning ..... 119/721
5,408,222 A * 4/1995 Yaffe et al. ..... 340/604
5,504,474 A * 4/1996 Libman et al. ..... 340/573.4
5,543,780 A * 8/1996 McAuley et al. ..... 340/572.1
5,619,187 A 4/1997 Serfontein
5,907,281 A 5/1999 Miller, Jr. et al.

(Continued)

OTHER PUBLICATIONS

CNET review of Motorola S9, dated Mar. 15, 2007.*

(Continued)

*Primary Examiner*—Daniel Wu
*Assistant Examiner*—John F Mortell
(74) *Attorney, Agent, or Firm*—Mark Nowotarski

(57) ABSTRACT

Electronic Tags are mounted on swimmers to reduce their risk of drowning by identifying when their heads are underwater for periods of time which may indicate a dangerous submersion situation, and for triggering corresponding alerts and alarms. In this method, each monitored person is equipped with a lightweight electronic Tag worn on the body that communicates with monitors that issue the alerts and alarms, including audible and visible distress signals. The monitors, in turn, communicate the alarms to receivers used by supervisory personnel, such as lifeguards or parents. The invention may be used in aquatic environments, such as public recreation facilities, pools, waterfronts, and water parks, as well as in more private settings, such as homes, apartment buildings or hotels.

48 Claims, 32 Drawing Sheets

U.S. PATENT DOCUMENTS

| | | | | |
|---|---|---|---|---|
| 5,945,912 | A | 8/1999 | Guldbrand | |
| 6,008,727 | A * | 12/1999 | Want et al. | 340/572.1 |
| 6,081,194 | A | 6/2000 | Sanchez | |
| 6,129,036 | A | 10/2000 | King et al. | |
| 6,154,140 | A * | 11/2000 | Thorpe et al. | 340/573.6 |
| 6,157,303 | A | 12/2000 | Bodie et al. | |
| 6,186,902 | B1 * | 2/2001 | Briggs | 472/117 |
| 6,327,220 | B1 | 12/2001 | Miller, Jr. et al. | |
| 6,825,767 | B2 * | 11/2004 | Humbard | 340/573.1 |
| 7,336,182 | B1 * | 2/2008 | Baranowski et al. | 340/572.1 |
| 7,479,891 | B2 | 1/2009 | Boujon | |
| 7,497,784 | B2 | 3/2009 | Henry | |
| 2003/0222782 | A1 * | 12/2003 | Gaudreau | 340/573.6 |
| 2004/0095248 | A1 | 5/2004 | Mandel | |
| 2004/0196180 | A1 | 10/2004 | Hollis et al. | |
| 2005/0088916 | A1 | 4/2005 | Zhu et al. | |
| 2005/0120796 | A1 | 6/2005 | Nash et al. | |
| 2005/0200481 | A1 | 9/2005 | Wallach | |
| 2006/0034155 | A1 | 2/2006 | Etchenique | |
| 2006/0214805 | A1 | 9/2006 | Boujon | |
| 2006/0280034 | A1 | 12/2006 | Howard et al. | |
| 2007/0070814 | A1 | 3/2007 | Frodyma et al. | |
| 2007/0076527 | A1 | 4/2007 | Romano | |
| 2007/0080806 | A1 * | 4/2007 | Lax et al. | 340/572.1 |
| 2007/0132578 | A1 | 6/2007 | Powell | |
| 2007/0159332 | A1 * | 7/2007 | Koblasz | 340/572.1 |
| 2007/0159925 | A1 | 7/2007 | Chryssostomidis et al. | |
| 2007/0223313 | A1 | 9/2007 | Kimball | |
| 2007/0247359 | A1 * | 10/2007 | Ghazarian | 342/357.07 |
| 2008/0266118 | A1 | 10/2008 | Pierson et al. | |

OTHER PUBLICATIONS

Gunatilaka and Ozanne-Smith, "A survey of inventions aimed at preventing drowning:study report", Monash University Accident Research Centre, Melbourne, Australia, Nov. 4, 2004.

"SUR-1 Submersible Ultrasonic Receiver", www.sonotronics.com/html/products/receivers/sur.html, last viewed Jun. 26, 2008.

"PT Series Subminiature Transmitters", www.sonotronics.com/html/products/transmitters/pt.html, last viewed Jun. 26, 2008.

"Manganese Dioxide Lithium Coin Batteries: Individual Specifications", Panasonic Lithium Handbook, Aug. 2005.

"Part No: CEB-20D64, Piezo Electric Diaphram", CUI Inc. Jul. 28, 2006.

"PIC10F220/222 Data Sheet", Microchip Technology Inc., DS41270A, 2005, pp. 1-7.

"Waterproof Headphones", H20 Audio Inc., http://h2oaudio.com/products.php, last viewed Jul. 14, 2008.

* cited by examiner

© 2008 Aquatic Safety Concepts LLC

© 2008 Aquatic Safety Concepts LLC

2720

ELECTRONIC SWIMMER MONITORING SYSTEM

CROSS-REFERENCE TO RELATED APPLICATIONS

This application claims priority from U.S. provisional patent application entitled "Swimmer Safety Tags", Ser. No. 60/951,243 filed on Jul. 23, 2007. Said provisional application is incorporated herein by reference.

FIELD OF THE INVENTION

The present invention is in the field of swimmer safety.

COPYRIGHT AND TRADEMARK NOTICE

A portion of the disclosure of this patent document contains material to which a claim for copyright is made. The copyright owner has no objection to the facsimile reproduction by anyone of the patent document or the patent disclosure as it appears in the Patent and Trademark Office patent file or records, but reserves all other copyright rights whatsoever.

The word "WAHOOO" and fish logo as shown, inter alia, as item 1116 in FIG. 11A are trademarks of Aquatic Safety Concepts LLC.

BACKGROUND

Drowning is the second leading cause of accidental death in children in the United States. Adults are present in ninety percent of those incidents, intending to monitor the children to prevent drowning, yet the children all too often drown in silence, as their instantaneous peril readily escapes notice. Adult drownings in supervised settings are sadly common for the same reason.

SUMMARY OF THE INVENTION

The Summary of the Invention is provided as a guide to understanding the invention. It does not necessarily describe the most generic embodiment of the invention or all species of the invention disclosed herein.

The systems and methods of the present invention are designed to assist supervisory personnel to monitor people to reduce the risk of dangerous submersions. The invention advances the art by providing effective and commercially economical means to automate prompt notice of supervisory personnel of a person in potential distress.

The systems and methods of the present invention comprise equipping each person to be monitored in an aquatic environment with an electronic Tag worn on the body at a position from which immersion of the nose and mouth can be inferred, together with means for timing the immersion of the Tag in water for one or more periods of time associated with possible risk of drowning, and means for communicating between the Tag and electronic monitoring equipment, including alarms, and devices for system control and communications.

BRIEF DESCRIPTION OF THE DRAWINGS

FIG. 12 is a top view of an alternative Tag design.

DETAILED DESCRIPTION

The following detailed description discloses various embodiments and features of the invention. These embodiments and features are meant to be exemplary and not limiting.

As used herein, the term "about" means within +/−20% of a given value unless specifically indicated otherwise.

Method for Increasing the Safety of Swimmers

FIGS. 1 to 8 illustrate an exemplary method for increasing the safety of swimmers as applied to a pool area. Similar methods can be applied to open water swimming areas, such a lake or ocean.

Figure 1:
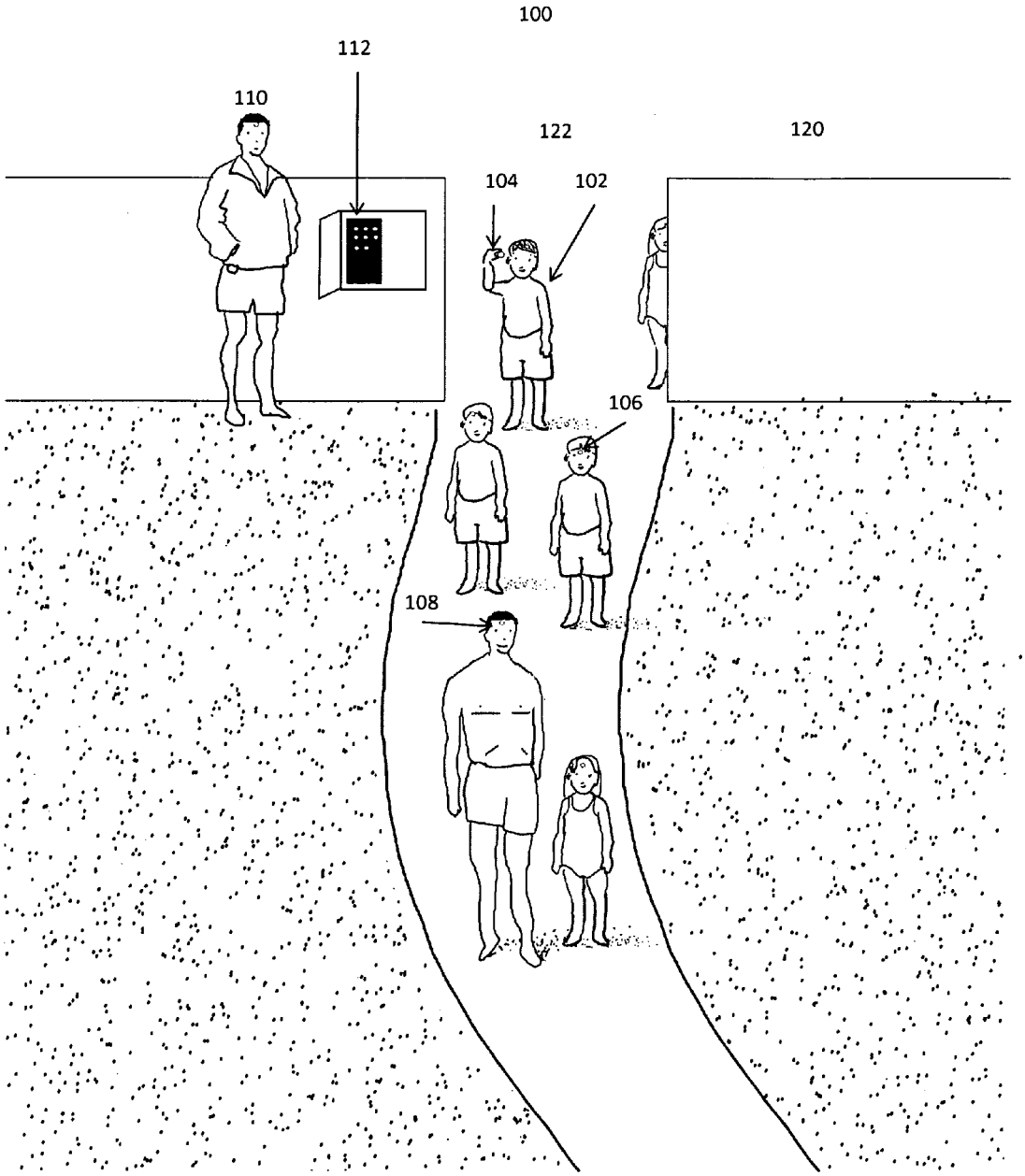
FIG. 1 is a view of the entrance to a pool area where swimmers place Swimmer Safety Tags on their persons.

Referring to FIG. 1, a pool area 100 is surrounded by a perimeter fence 120 with an opening 122 therein. Swimmers, such as children 102, or adults 108, pass through said opening on their way to the pool area. Each swimmer is provided with a Swimmer Safety Tag 104 that is affixed to a position on his or her head. Suitable positions include the forehead 106 or behind an ear. The Tags are provided with an adhesive so that they will remain affixed even in water, but can be removed without undue force or discomfort. Hence said Tags are said to be "removably mountable". The adhesive used in waterproof bandages is suitable.

The Tags may be stored in a locker 112. A supervisor 110 may be present to provide assistance with putting a Tag on and/or to make sure that all persons entering the pool area are "Tagged".

Figure 2:
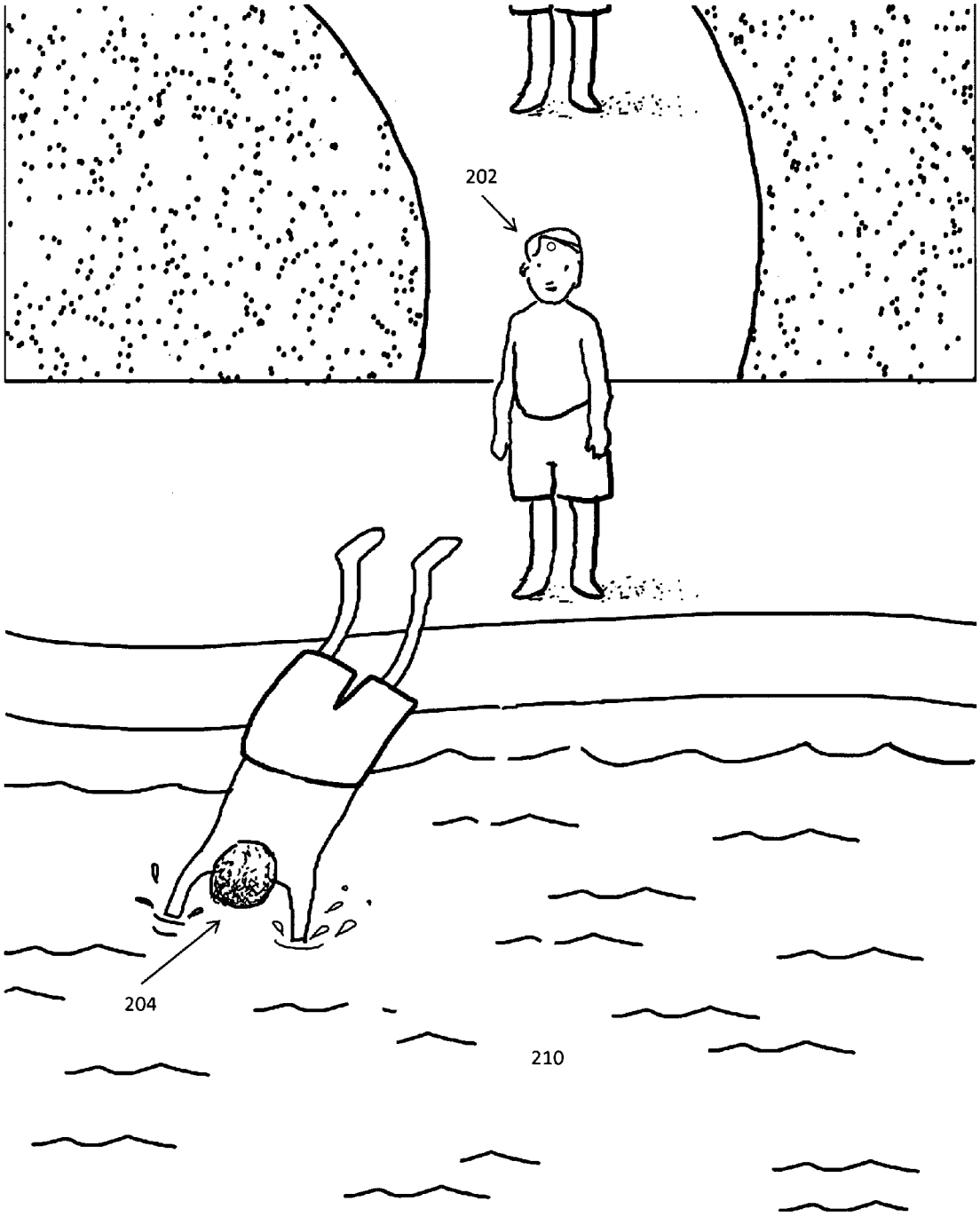
FIG. 2 is a view of swimmers wearing Tags entering the water.

Referring to FIG. 2, the Tags 202 are electronic devices which will determine, inter alia, how long a person's head has been underwater and hence, by implication, how long both their nose and mouth are underwater. If a person's head has been underwater longer than a predetermined safe period, such as 30 seconds, an alarm will be triggered. Different alarm levels may be set at different time periods. A "Yellow Alert" may be set in the range of 20-30 seconds. A "Red Alarm" may be set in the range of 30-45 seconds. A preferred range for Yellow Alerts is 20 to 25 seconds. This will provide adequate warning to a lifeguard to identify, rescue and administer first aid to a distressed swimmer. A 20-25 second delay to Yellow Alert may be particularly suitable for young children, such as those six years old and under. These children would be less likely swim underwater for 25 seconds as part of their normal play the way older or more skilled children can.

An alternative alarm is simply a Red Alarm that is triggered by a Tag being underwater for 25 seconds or longer.

The Tags are activated when a person's head 204 enters the water 210. The alarm signal may be an ultrasonic signal transmitted through the water.

Figure 3:
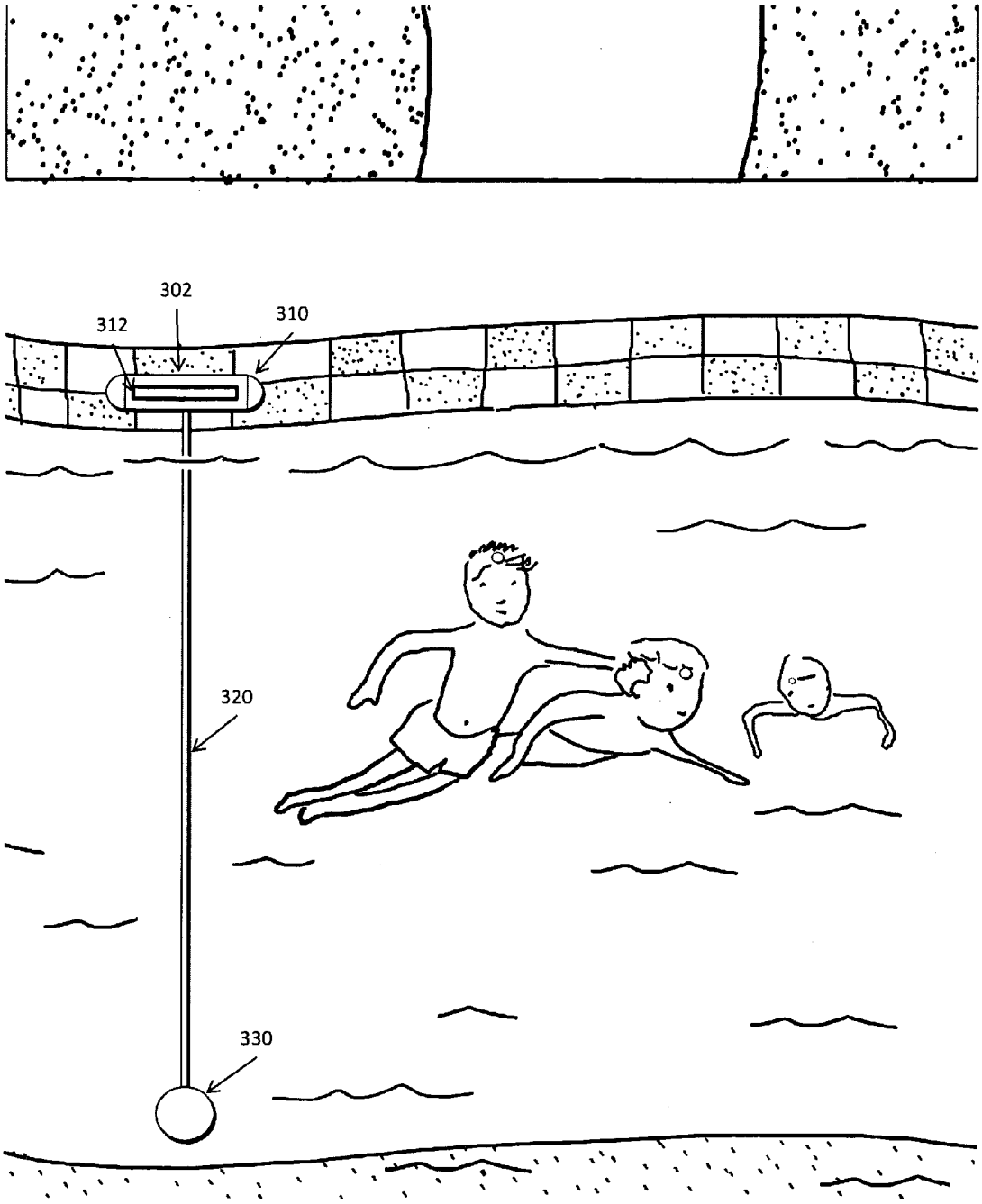
FIG. 3 is a view of swimmers being monitored by a Swim Monitor Unit.

Referring to FIG. 3, the pool water is monitored by one or more Swim Monitor Units (SMU) 302. A Swim Monitor Unit comprises an annunciation unit 310, a connector cable 320 and a hydrophone unit 330. The annunciation unit may comprise a strobe light 312. They hydrophone unit may be placed near the bottom of the pool.

Figure 4:
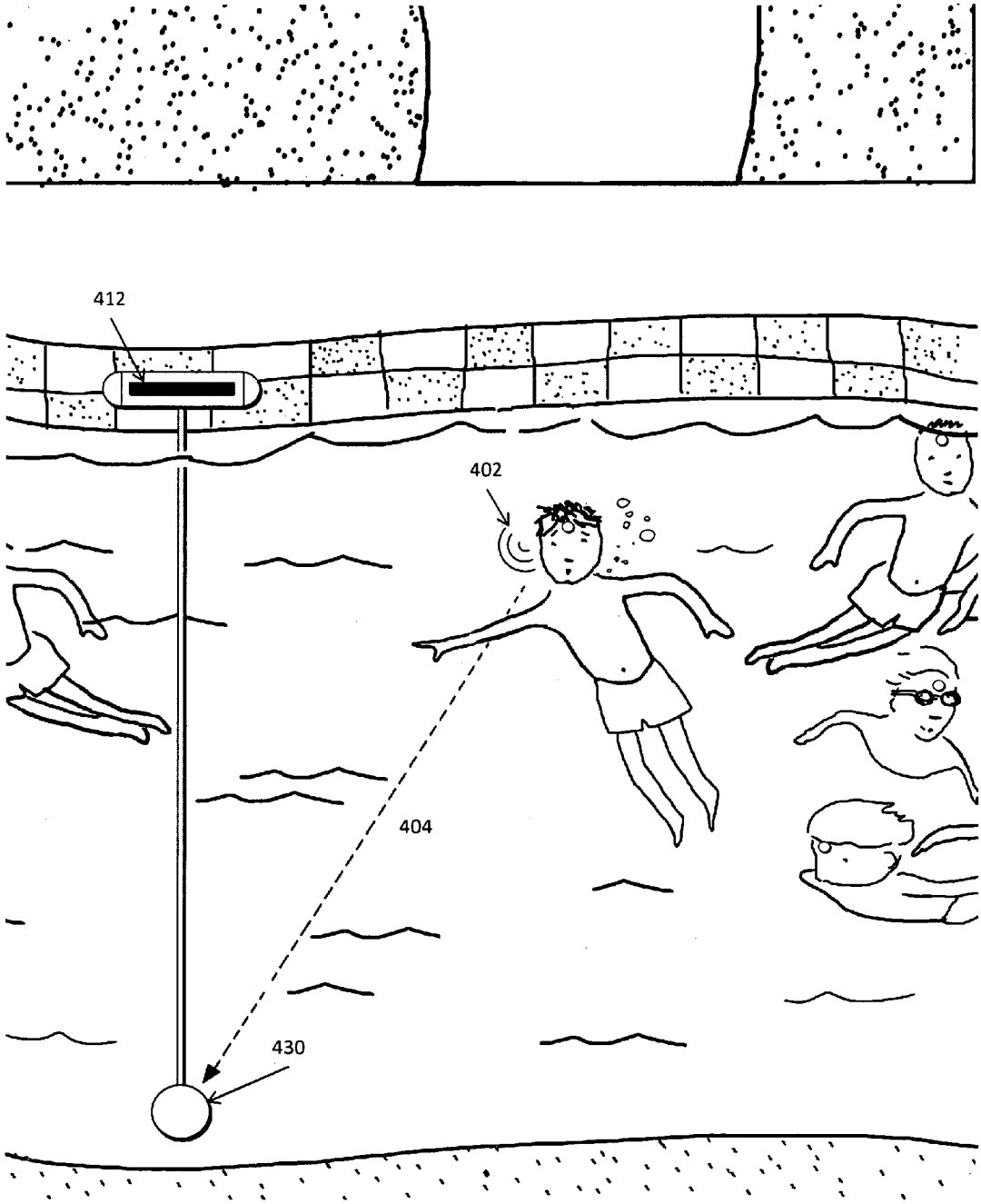
FIG. 4 is a view of a swimmer setting off a Yellow Alert.

Referring to FIG. 4, the hydrophone unit 430 listens for ultrasonic signals from the Tags. If a swimmer's head had been below the water for more than the Yellow Alert period, for example, then that swimmer's Tag gives off the ultrasonic Yellow Alert 402. The signal is received 404 by the hydrophone unit and is transmitted (e.g. electrically) along the connector cable to the annunciation unit and the annunciation unit takes appropriate action, such as flashing the strobe 412.

Figure 5:
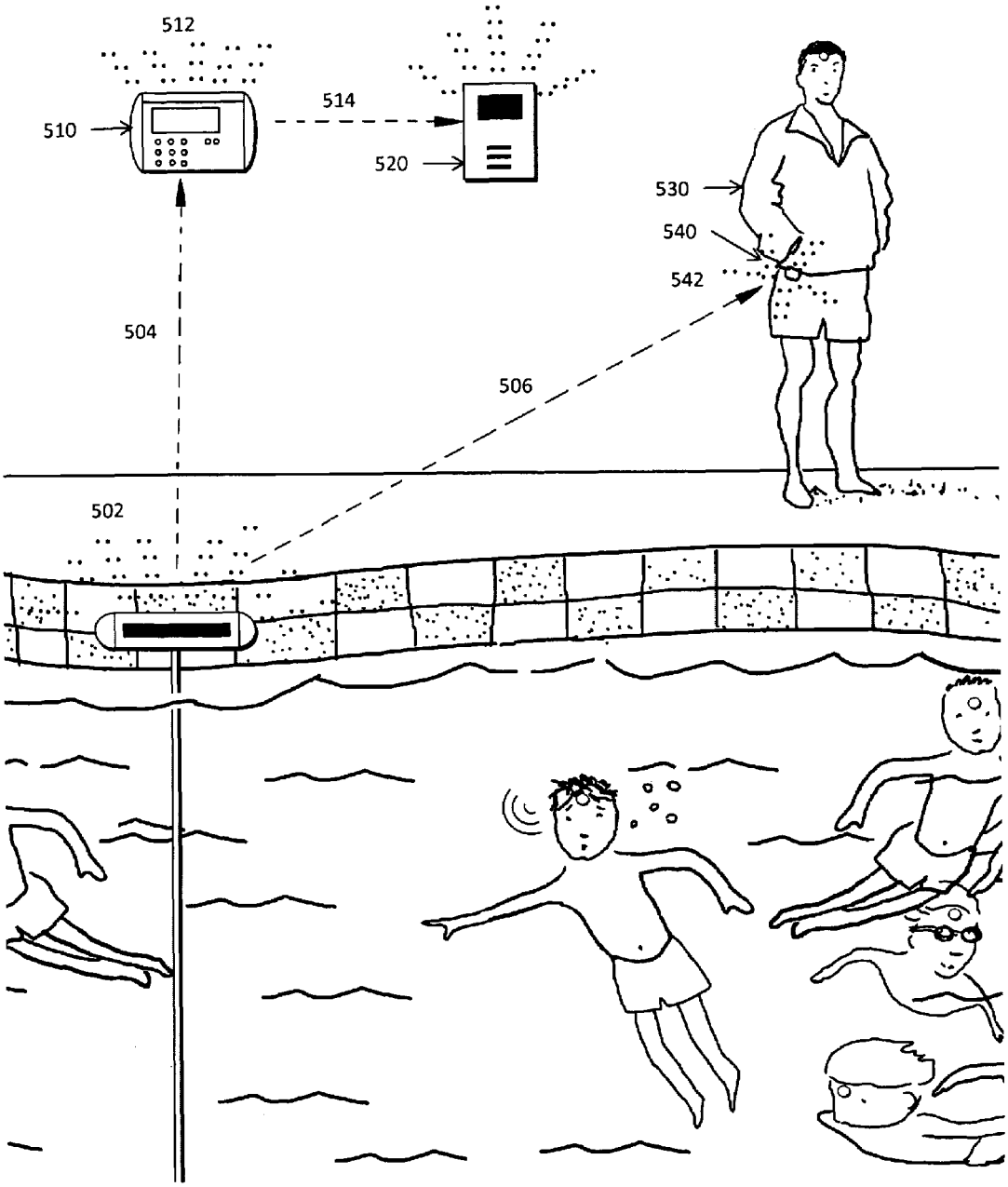
FIG. 5 is a view of lifeguard and Control Unit being notified of a Yellow Alert.

Referring to FIG. 5, in addition to flashing the strobe, the annunciation unit 502 may also transmit a radio signal 504 to a nearby Supervisory Control Unit 510. The radio transmission may be at typical frequency bands allocated to alarms, such 433 MHz The Control Unit, in turn, may also take appropriate action, such as flashing its strobe 512 and activating 514 other visual or audio alarms 520.

Alternatively or in addition, the annunciation unit may communicate 506 an alarm signal directly to a portable reception unit 540 worn by a lifeguard 530. Communication may be via suitable portable unit communications means, such as digital signals utilizing Bluetooth® technology or Bluetooth® Version 2 technology (collectively "Bluetooth" herein). The portable reception unit may notify the life guard that there is an alert via light, noise and/or vibration 542.

Upon activation of a Yellow Alert, a lifeguard may take appropriate action, such as to call for a "buddy check" where all swimmers grab their buddy's hand and hold it up. This way the lifeguard can quickly confirm and identify which swimmer is in distress.

Figure 6:
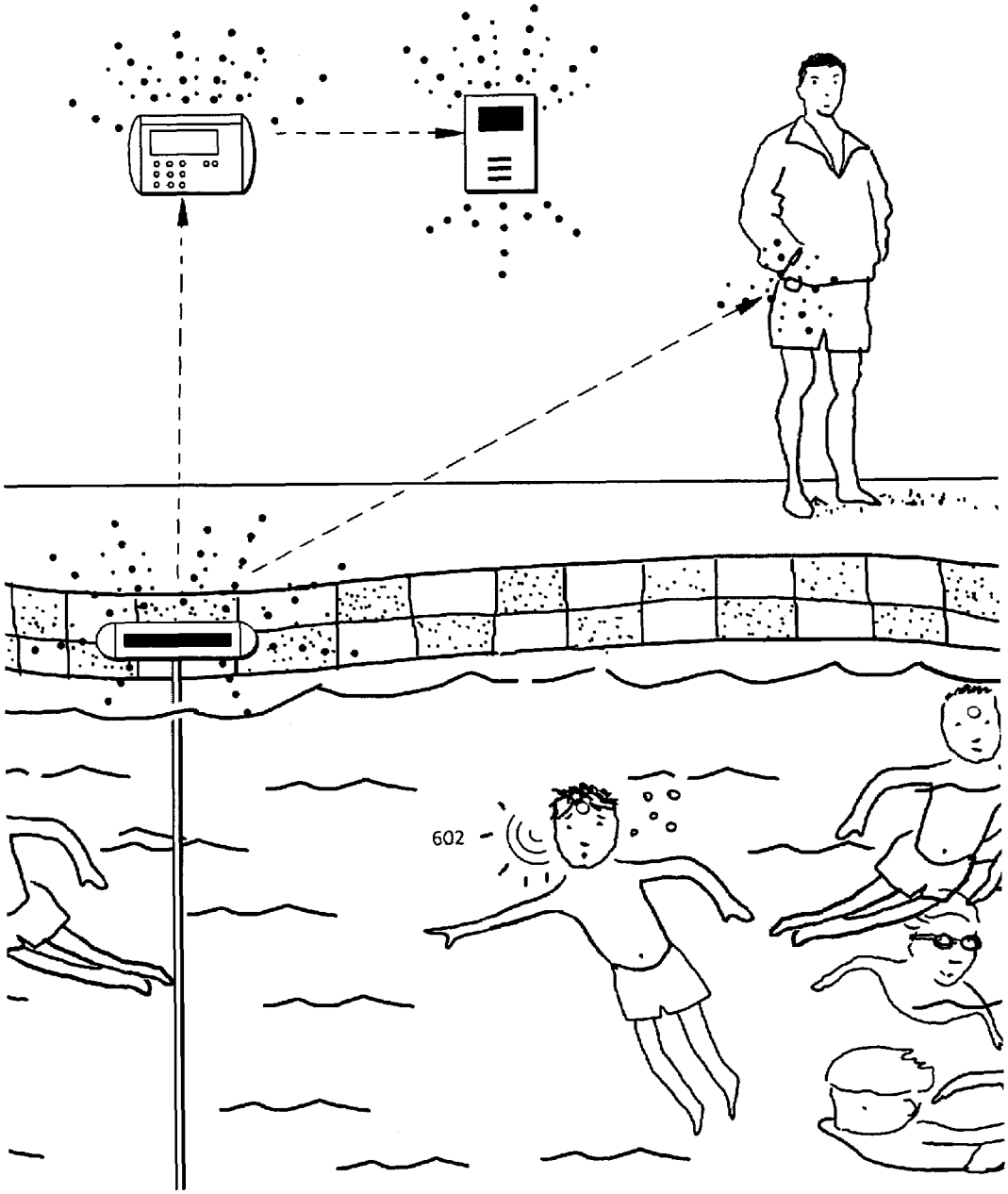
FIG. 6 is a view of a swimmer setting off a Red Alarm.

Referring to FIG. 6, if a swimmer's head is underwater for more than the Red Alarm period (e.g. 45 seconds), then the Swimmer Safety Tag may transmit 602 a Red Alarm. The hydrophone will receive the Red Alarm and the annunciation unit and other components of the system may take appropriate action, such as sounding an audio alarm or notifying local emergency medical personnel. The lifeguard, in turn, may take appropriate action, such as clearing the pool of all swimmers and searching for the swimmer in distress.

Figure 7:
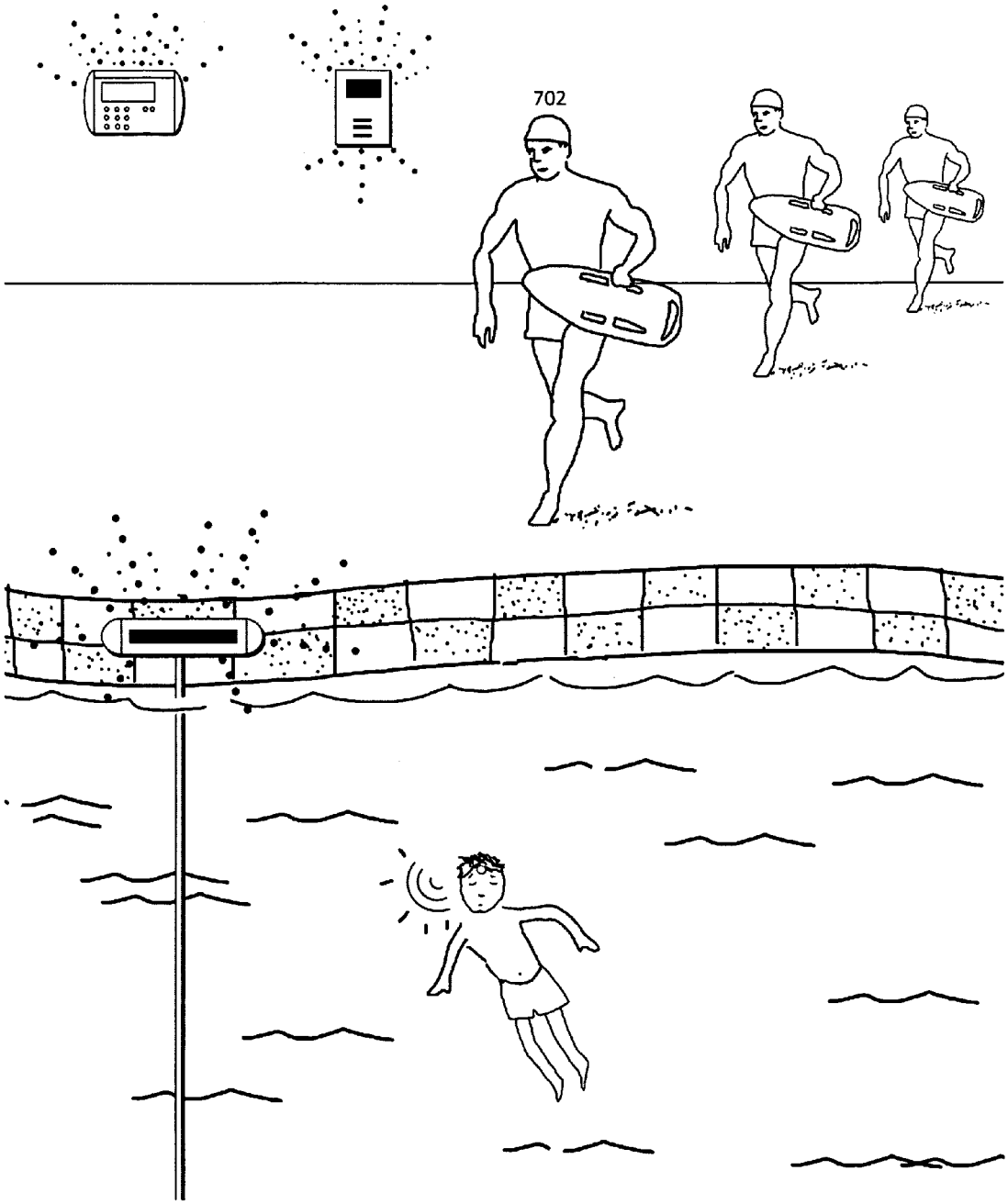
FIG. 7 is a view of a lifeguard responding to a Red Alarm.
Figure 8:
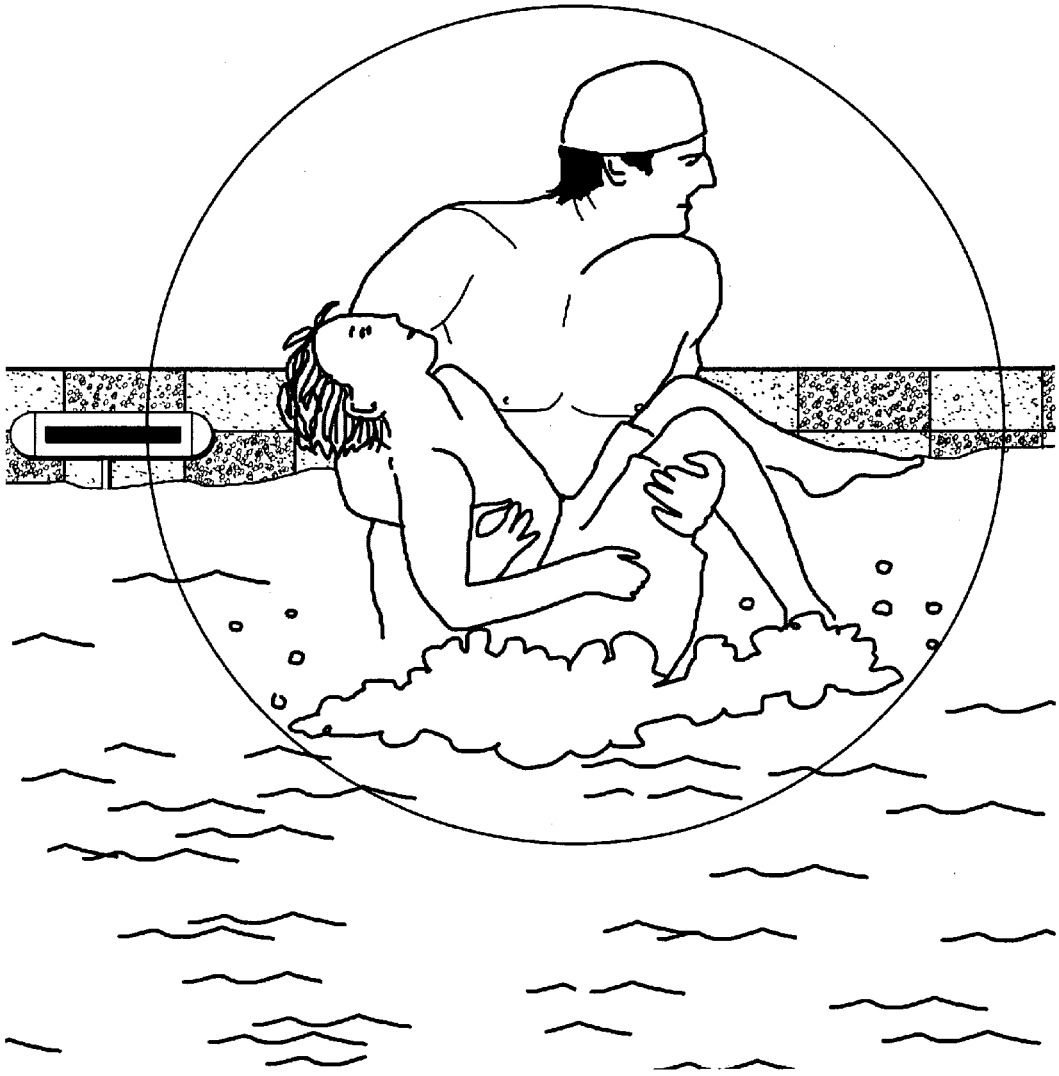
FIG. 8 is a view of a lifeguard rescuing a swimmer who triggered a Red Alarm.

Referring to FIGS. 7 and 8, once the swimmer in distress is located, the lifeguard 702 can retrieve the swimmer and apply appropriate first aid if needed. The life guard may also reset the alarm system to the standby state and silence the alarms.

In an alternative embodiment, the Red Alarm automatically resets after a certain period of time. 1 to 2 minutes is an appropriate period of time. The benefit of a Red Alarm automatically resetting after 1 to 2 minutes is that by that time, it is likely that a lifeguard is applying first aid to the distressed swimmer. A continuous alarm would otherwise distract the lifeguard during the administration of first aid when the lifeguard must pay particular attention to, for example, the proper administration of artificial respiration.

System for Increasing the Safety of Swimmers

It will be appreciated by a person of ordinary skill in the art of water safety, that a practical system implementing the methods describe herein must simultaneously meet a number of demanding criteria. These criteria include, but are not limited to:

- Acceptably low number of "false positives". Similar to the "Boy who Cried Wolf", If the system constantly indicates that a swimmer is in distress when, in fact, that isn't the case, then personnel will learn to ignore the system and thus not respond appropriately when a swimmer really is in peril.
- Very low number of false negatives. The system must be very reliable in terms of identifying swimmers that really are in distress.
- Acceptable to users. The system, and in particular the Swimmer Safety Tags, must be acceptable to the users. Otherwise they will resist using them, their enjoyment will be degraded and their safety compromised. Similarly, the supervisory personnel, such as lifeguards, must find the system easy to use and understand.
- Cost effective. The cost of the system must be commensurate with the benefits provided, competitive with alternatives, and encourage its use.
- Safe to use. The system should not introduce new safety hazards that negate the overall benefit provided to the users. Similarly, the system should be environmentally compatible.

Figure 9:
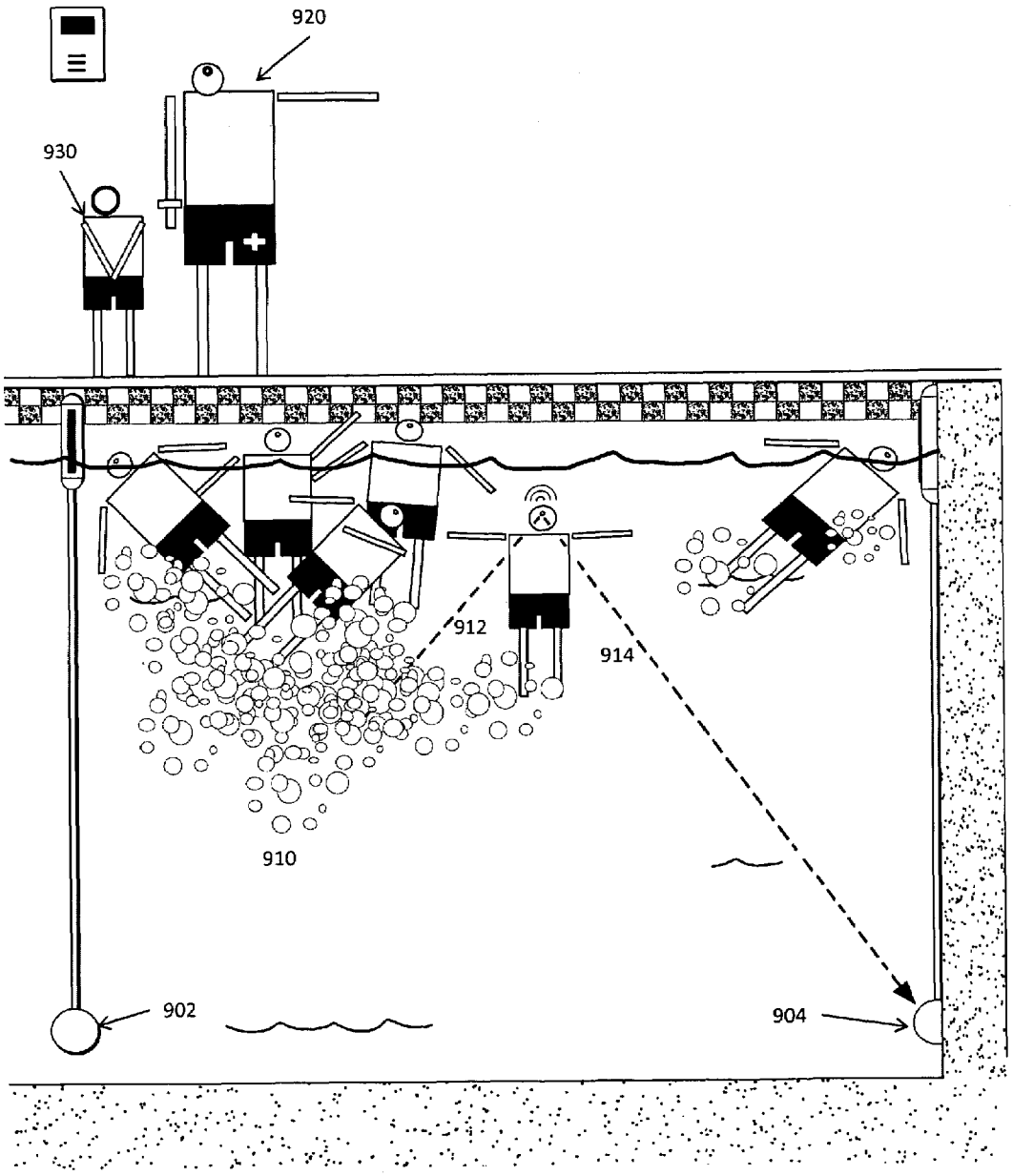
FIG. 9 is a view of a pool with exemplary hydrophone placement.
Figure 10:
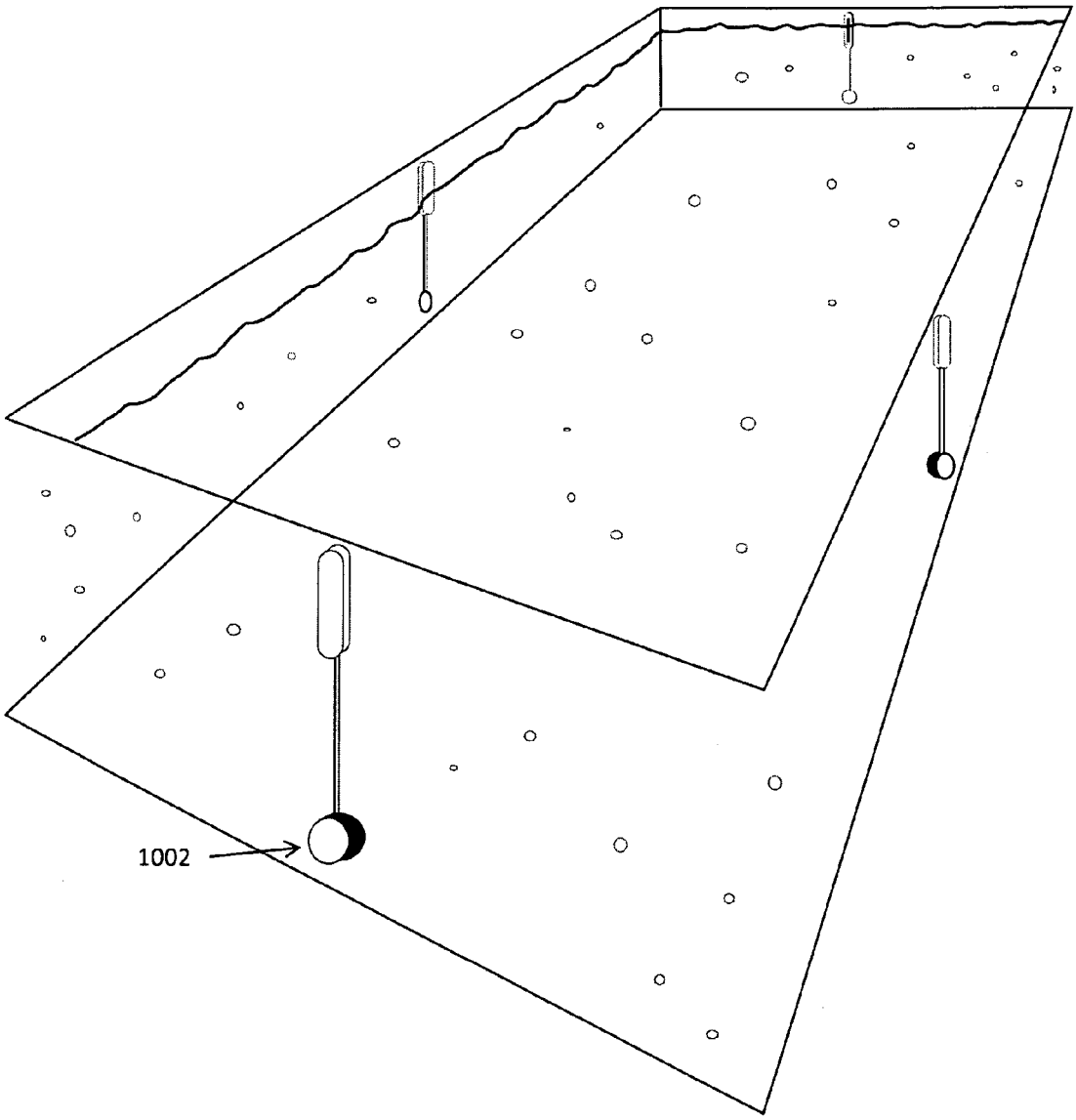
FIG. 10 is a view of a pool with alternative exemplary hydrophone placement.

FIGS. 9 and 10 illustrate an embodiment of the present invention that has improved reliability in terms of picking up a swimmer's ultrasonic distress signal (i.e. lower false negatives). It is common for splashing, bubbles and clusters of swimmers 910 to exist from time to time in a pool. These effects can collectively block a distress signal 912 from reaching a given hydrophone 902. With at least a second hydrophone 904 mounted in the pool, the probability of a distress signal 914 reaching at least one unit is significantly increased. Suitable positioning of four hydrophones 1002 is illustrated in FIG. 10.

Referring back to FIG. 9, in addition to normal duties, a lifeguard 920 may be responsible for observing all swimmers and insisting that any swimmer 930 without a Tag either get a Tag or leave the pool area. This task can be facilitated by providing Tags with a light so that they can be more easily seen.

Figure 11A:
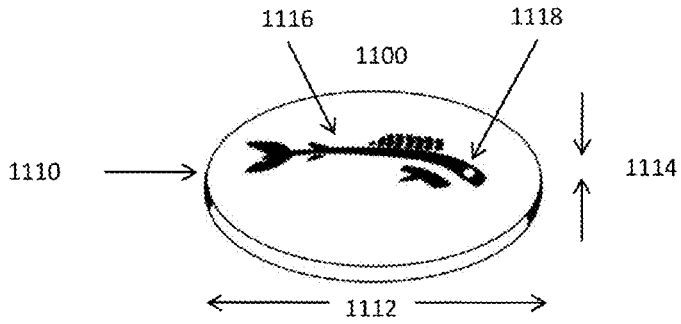
FIGS. 11A-11D are views of an exemplary Swimmer Safety Tag ("Tag").

FIGS. 11A-11 D illustrate embodiments of the Tags that have improved user acceptability and reduced numbers of false positives. FIG. 11A illustrates a top perspective view of a Tag; FIG. 11B illustrates a bottom perspective view of a Tag; FIG. 11C illustrates the size scale of a Tag; and FIG. 11D illustrates the mounting of a Tag on a swimmer.

Figure 11B:
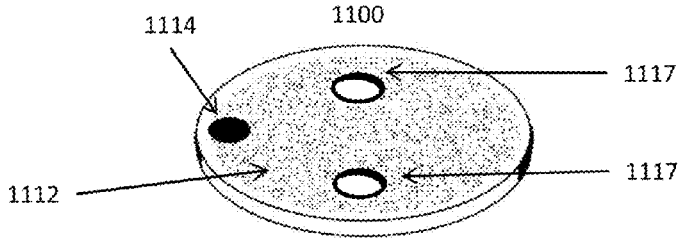
Figure 11C:
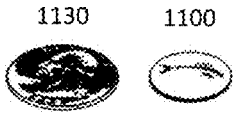
Figure 11D:
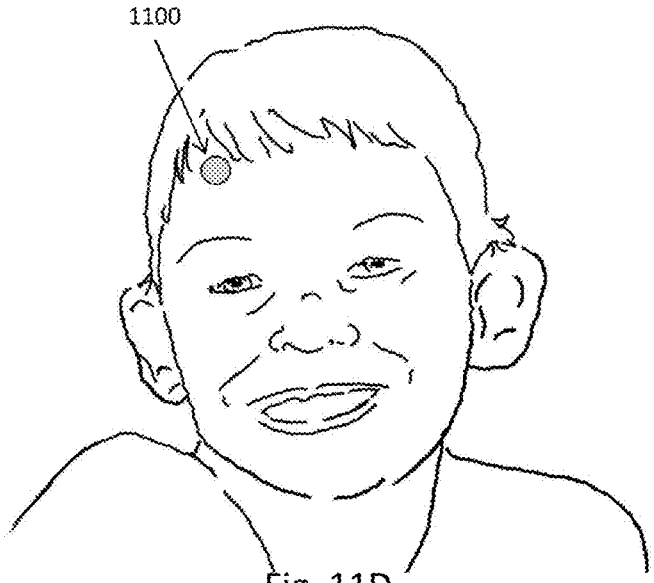

Referring to FIGS. 11A and 11C, a Tag 1100 may have a diameter 1112 in the range of 5 to 30 mm, and a thickness 1114 in the range of 1 to 10 mm. A preferred range for diameters is 10 to 20 mm. A preferred range of thicknesses is 3 to 5 mm. These dimensions give the Tag a size, shape and heft (i.e. perceived weight in the hand) comparable to that of common coins (e.g. US pennies, dimes, nickels and quarters 1130). An exemplary Tag, for example, would have a diameter of 20 mm, a thickness of 5 mm and a weight of 3 gm in air. The maximum suitable weight would be 10 gm in air. Thus mounting a Tag on a swimmer's head (FIG. 11D) would not be perceived as an undue burden. Furthermore, Tags could be effectively manipulated by persons of ordinary physical skill and dexterity. Supervisory personnel could place Tags on persons with physical handicaps.

The top surface of a Tag could be provided with a logo 1116 or other suitable indicia such as a decoration (e.g. flower) or affinity brand (e.g. sports logo). A light source, such as an LED 1118, can be provided for easy identification as well as providing an indication that the Tag is functioning properly. The LED may blink at a frequency of no less than once every 10 seconds. This will help conserve battery life. The Tag may also be programmed to flash the LED or multiple LEDs very brightly or frequently in the event of a Yellow or Red Alarm. This will help a lifeguard identify which swimmer is in distress. The LEDs may also change color in response to a Yellow or Red Alarm.

Electrical contacts 1110 may be provided on opposite sides of a Tag to sense immersion in water. The water acts as a conductor and closes a circuit between the contacts when the Tag is immersed. An internal timer then initiates. If the Tag is removed from water, the circuit is open and the timer stops and resets.

Referring to FIG. 11B, an adhesive 1112 may be provided on the bottom of a Tag. The adhesive should be medical grade, hypo-allergenic and non-irritating. It should be able to adhere the Tag to a swimmer's head for not less than 10 hours.

A sensor 1114 may also be provided on the bottom of the Tag to confirm that the Tag is mounted on a person. The sensor may be an optical switch that opens when illuminated. Thus when the Tag is mounted on a person, the switch is dark and closed and the internal circuitry functions normally. If the Tag is removed or falls off, then the switch is illuminated and opens. The Tag may either then stop functioning, or may issue a signal indicating that it is no longer mounted on a person. If the Tag is made more dense than water, it will sink and can be retrieved by a vacuum. If a Tag is less dense than water, it will float and can be retrieved by skimming.

An alternative sensor is one that optically measures oxygen in the blood directly below the Tag. This can be used to confirm mounting on the person as well as provide an alternative measure of the distress of a person. If the oxygen is low, then the person is in distress. Similarly, the pulse can be measured and interpreted accordingly.

Another alternative sensor comprises a pair of electrical contacts 1117 on the bottom of a Tag. They are normally dry as long as the Tag is mounted on a person. If the Tag falls off in the water, however, then the contacts are connected electrically through the conductivity of the water and the Tag has an indication that it is no longer mounted on a person.

Figure 12:
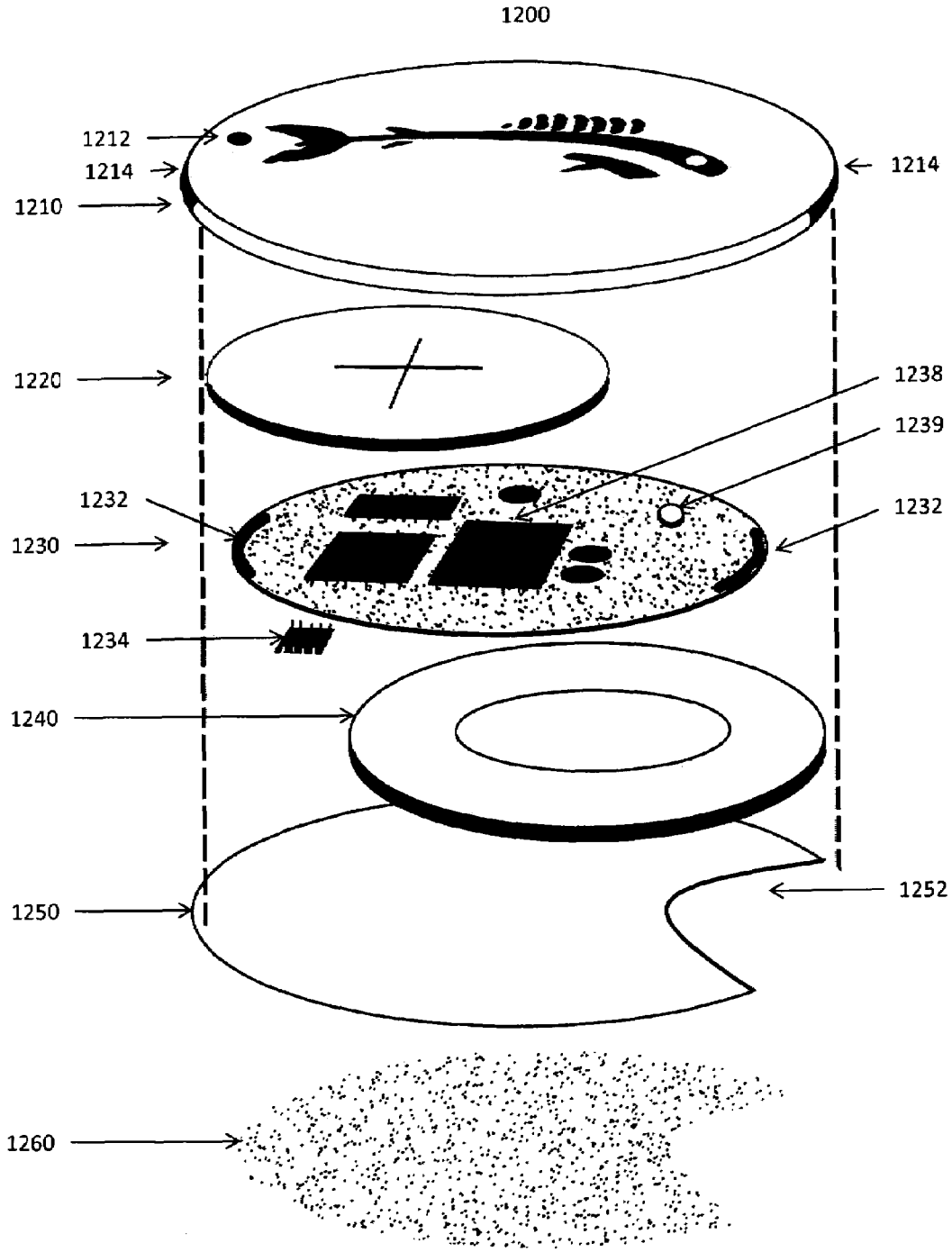
FIG. 12 is an exploded perspective view of a Tag.

FIG. 12 illustrates an exploded perspective view of the Tag of FIGS. 11A-11D. The Tag 1200 comprises a top encapsulating layer 1210, a battery 1220, electronic circuitry 1230, a piezoelectric transducer 1240, a bottom encapsulating layer 1250 and an adhesive layer 1260.

The top encapsulating layer may be a waterproof, two-part epoxy designed to protect electronics that are submerged in water. The Tag should be water proof to a depth of 300 meters. The epoxy may be cast over the electronics and underneath and allowed to harden. Alternatively, the top encapsulating layer may be a cover that is bonded to the bottom encapsulating layer.

Openings 1214 may be milled in the top encapsulating layer after it hardens to expose electrical contacts 1232 on the circuit board of the electronic circuitry. This would allow the circuit between the electrical contacts to close when the Tag was immersed in water and thus begin a timer. Alternatively, a conductor 1212 may pass through the top of the encapsulating layer as one contact, and one or more opening 1252 may be milled in the bottom encapsulating layer to expose the piezoelectric layer. The piezoelectric layer, therefore, acts as the second contact. The circuit between the top conductor and piezoelectric layer then is closed when the Tag is immersed in water. Four openings 1252 may be milled at four compass points to reduce the chance that a swimmer's skin blocks all of the openings to the piezoelectric contact.

Both the electrical circuit components and programming logic are chosen to give reliable performance with minimized power draw. This improves the reliability and lifetime of the Tag. The Tag may have an operating lifetime of at least 30 days, and a storage shelf-life of at least 2 years. The Tag may further comprise an activation means, such as a pull tab, which turns the Tag on.

The electrical circuit comprises a micro processor 1234, amplifier 1238 and optional LED 1239.

A suitable micro processor is a PIC10F220, 6 pin, 8 bit flash microcontroller by Microchip Technology Inc. Said microprocessor is more fully described in PIC10F220/22 Data Sheet, publication number DS41270A by Microchip Technology Inc, 2005. Said publication is incorporated herein by reference. Other microprocessors with similar performance, power draws, cost and size characteristics may also be suitable.

The microprocessor may be programmed to have different outputs in different states. The states and outputs are presented in Table 1.

TABLE 1

| State | Output | Duty Cycle (Duration per 1.1 or 2.2 second cycles) |
|---|---|---|
| Resting | 71.4 kHz square wave (ultrasonic) | 15 ms |
| Yellow Alert | 71.4 kHz square wave | 300 ms |
| Red Alarm | 71.4 kHz square wave | 700 ms |
| Low battery (<20% remaining power) or detached Tag | 1.2 kHz square wave (audible) | 750 ms |

The output of the microprocessor is amplified by the amplifier and then used to drive the piezoelectric layer to give the ultrasonic or audible signal. An inductor may be placed in series with the piezoelectric layer. The inductance is selected based on the effective capacitance of the piezoelectric layer to give a resonance frequency of the circuit about that of the desired ultrasonic frequency. This improves the power efficiency of the circuit.

A suitable piezoelectric layer is a CEB-20D64 piezoelectric diaphragm made by CUI Inc. The technical specifications of said diaphragm are described more fully in the CUI spec sheet for the CEB-20D64 dated Jul. 28, 2006. Said spec sheet is incorporated herein by reference. This diaphragm is disk shaped and has a suitable diameter (20 mm), material of construction (brass) and cost ($0.75 ea) for this application. It is surprising that it provides adequate ultrasonic emissions, however, given that the mechanical resonance frequency is 6.5+/−0.5 KHz.

The resting state is the normal default state of the system. The microprocessor is normally in a very low current "sleep" mode. Every 1.1 or 2.2 seconds (selectable by the user), it "wakes up" and determines the state that it is in. If the clock timer indicating submersion is less than the Yellow Alert level (e.g. less than 30 seconds) then it gives a 15 ms ultrasonic "ping" at 71.4 kHz. Ultrasonic frequencies in the range of 30 kHz to 100 kHz may also be used. At lower frequencies, naturally occurring ambient noise causes interferences. At higher frequencies, more expensive and different shaped (e.g. cylindrical) ultrasonic transducers must be used. 71.4 kHz was selected in this particular application since it represents an even multiple of the clock speed of the microprocessor. Thus, generating the square wave comprises counting clock cycles. It also gives a wavelength of the ultrasonic transmissions in water of about 2 cm. This wavelength is suitable in pools. Longer wavelengths, such as 10 cm, can lead to "dead spots" in the pool where the emitted ultrasonic waves destructively interfere with each other might not be heard by a hydrophone if said hydrophone were located in said dead spot.

The ping can be received by the hydrophones and might serve, for example, for counting the number of swimmers in the water in any given time. Ideally the ping should be as short as possible to minimize resting state power draw on the battery. Ping durations in the range of 5 ms to 30 ms are acceptable. The ping should have a large enough amplitude or power so that it is detectible by a hydrophone no less than 50 meters away.

If the microprocessor wakes up and determines that the submersion timer has exceeded the Yellow Alert level, then it gives a Yellow Alert signal of 300 ms at 71.4 kHz. This is immediately picked up by one or more hydrophones and a Yellow Alert is initiated. The nearest hydrophone to the signal may have an appropriate indication to assist the lifeguard in locating the distressed swimmer. The microprocessor may also simultaneously drive the piezoelectric layer to emit a loud sonic signal. This will help a lifeguard identify which swimmer is in distress.

If the microprocessor determines that the submersion timer has exceeded the Red Alarm level, then a Red Alarm signal of 700 ms is given. The hydrophones then react accordingly.

The relative and absolute length and frequency of the Yellow Alert and Red Alarm signals can be varied so long as they are readily discriminated by the hydrophones. An advantage of selecting a Red Alarm duration that is more than twice the duration of a Yellow Alert signal is that the system can discriminate between two simultaneous Yellow Alerts and a single Red Alarm. An advantage of having a pause between Red Alarm signals is that the system can discriminate between a single Red Alarm signal and multiple Red+Red or Red+Yellow signals. Multiple Red+Red or Red+Yellow signals would indicate that more than one swimmer was at risk.

An advantage of having each tag broadcast a similar signal is that the Yellow Alert or Red Alarm message will get through even if there is significant echoing within the pool.

The system can be designed to provide digital information encoded in the ultrasonic carrier wave. This has the advantage of being able to directly identify which tag is emitting a distress signal.

The low battery and/or detached Tag signal can be initiated when the battery voltage indicates that less than 20% of the battery life is remaining or when a sensor indicating that a Tag is immersed but not attached to a swimmer is indicated. The signal can be an audible 1.2 kHz signal pulsed for 750 ms per cycle. 0.5 to 2.0 kHz are also acceptable. The audible signal has the advantage of making it readily apparent to persons nearby that a Tag has a low battery or is off of a person.

A suitable battery is a CR1616 2, 3V, Lithium Coin Cell battery made by Panasonic. The technical specifications of these batteries are described more fully in the Panasonic Lithium Handbook, August 2005. Said handbook is incorporated herein by reference. The batteries are rechargeable, have a size that is suitable for this application and have a power rating of 50 milliamp hours at 3V when fully charged. A power rating of 25 to 74 milliamp-hours is suitable in this application.

The above described system has a current draw of 2 micro amps when it is in storage. That gives an estimated battery shelf life of about 3 years. The Resting state current draw is 65 micro amps. That corresponds to a 30 day life of submersions. There is enough power to give a Red Alarm for 16 hours. The low battery signal will last 8 days.

The order of the layers in FIG. 12 can be varied. The battery, for example, can be below the electronic circuit.

Figure 13:
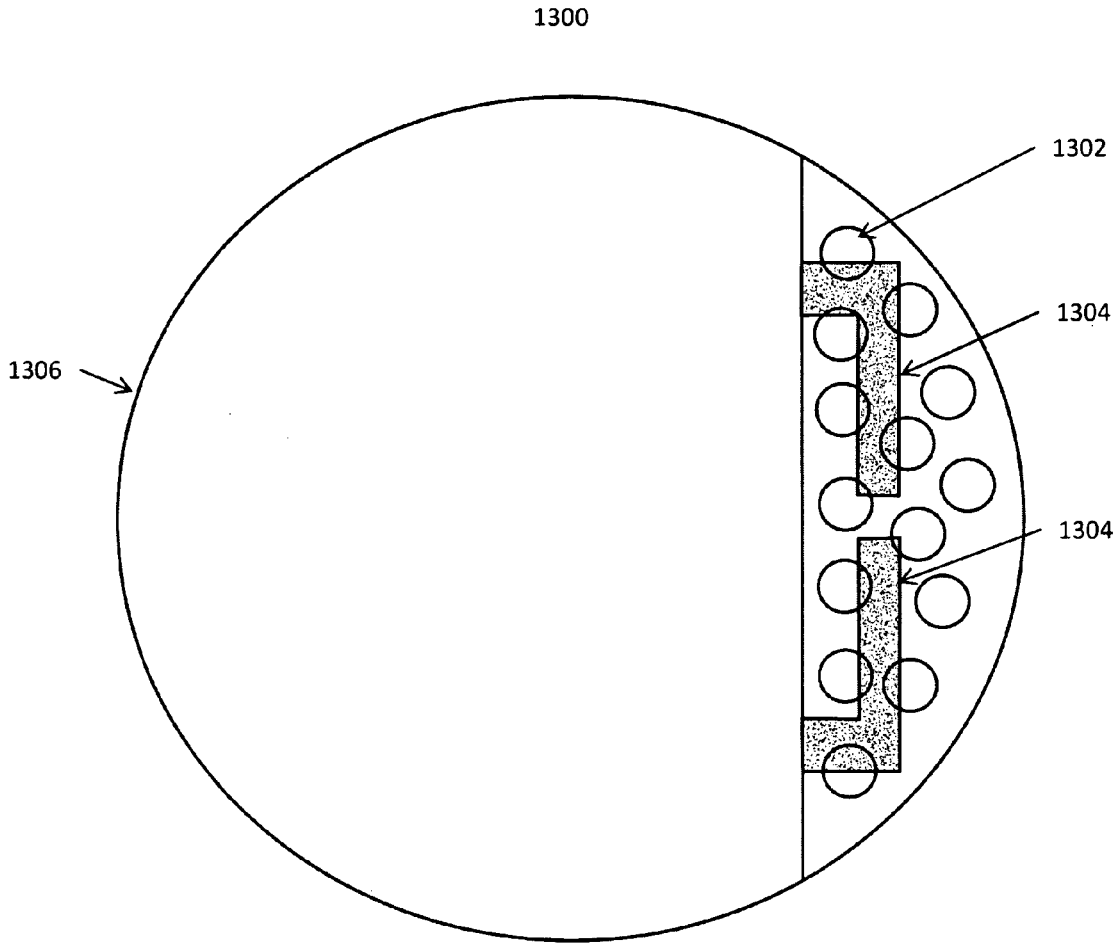

FIG. 13 shows a top view of an alternative Tag design 1300 for detecting submersion. The circuitry is sealed within a water tight enclosure 1306. Electrical contacts 1304 protrude into a porous protective enclosure 1302. When water penetrates the enclosure, the circuit is closed.

Packaging of Tags

FIGS. 14A-14D illustrate cross sections of a suitable packaging method for the Tags.

Referring to FIG. 14 A, a packaging card 1410 comprises a substrate layer 1412, and adhesive layer 1414 and a backing layer 1416. The substrate and backing layers may be made of cardboard. The adhesive layer may be a double stick tape with hypoallergenic, waterproof bandage adhesive. A round opening 1418 is provided to receive a Tag 1400. The Tag has rounded edges 1401 to facilitate handling. The opening may comprise a protective bumper 1420. The Tag is pressed onto the exposed adhesive layer 1406 which, in turn, is backed by a disk 1402. The disk is made of a material that the adhesive does not stick well to.

Figure 14A:
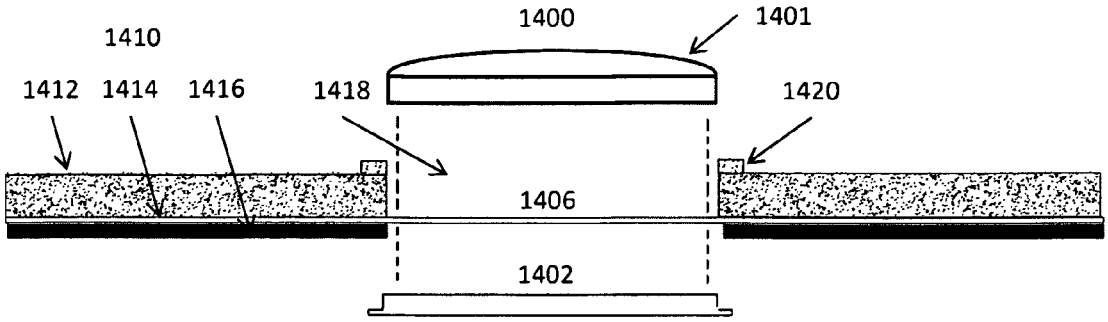
FIGS. 14A-14D are cross sectional views of an exemplary means for packaging and dispensing Tags.
Figure 14B:
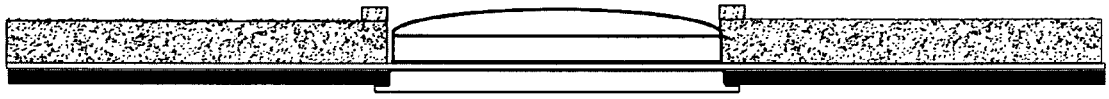

FIG. 14B shows how the assembly looks for shipping.

Figure 14C:
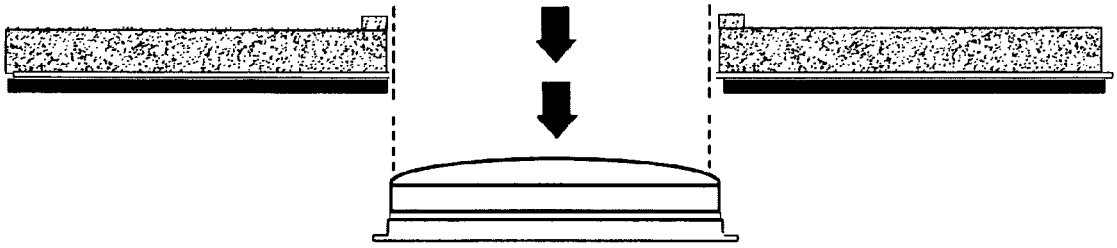

FIG. 14C shows how a Tab would be pushed out of the packaging card by an end user.

Figure 14D:
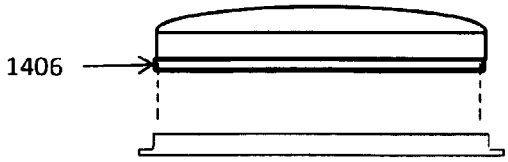

FIG. 14D shows how the backing disk would be removed leaving behind the adhesive layer 1406.

The adhesive should stick more strongly to the Tab than it would to a person's skin so that the adhesive is removed from said person's skin when the Tab is removed.

Figure 15:
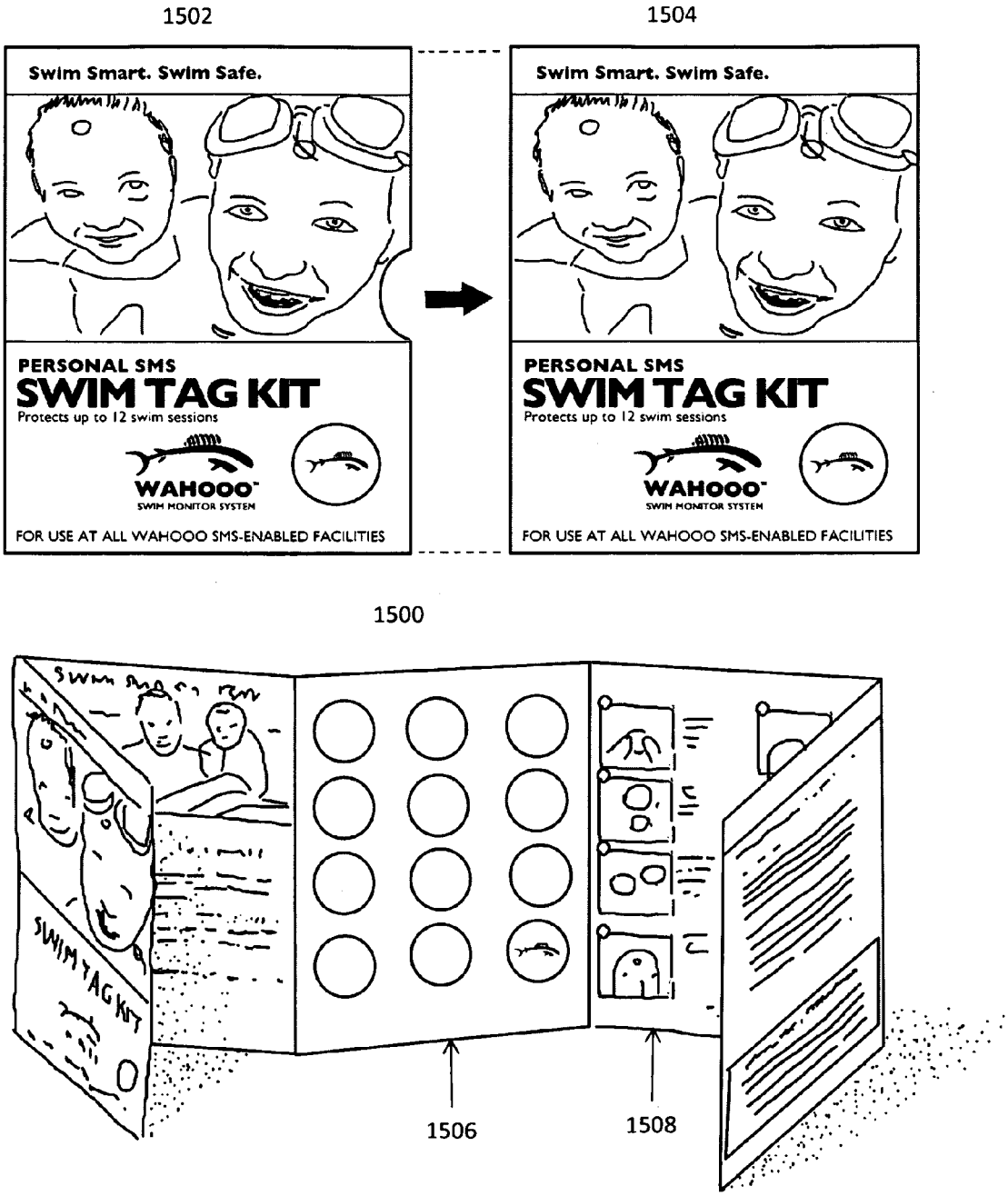
FIG. 15 is a perspective view of an exemplary means for packaging Tags for retail sale.

FIG. 15 shows how a packaging card 1506 would be incorporated into a commercial retail package 1500. Wings 1508 may be attached to the packaging card with appropriate information and indicia printed thereupon. The assembly may be folded 1504 and inserted into a sleeve 1502.

Figure 16:
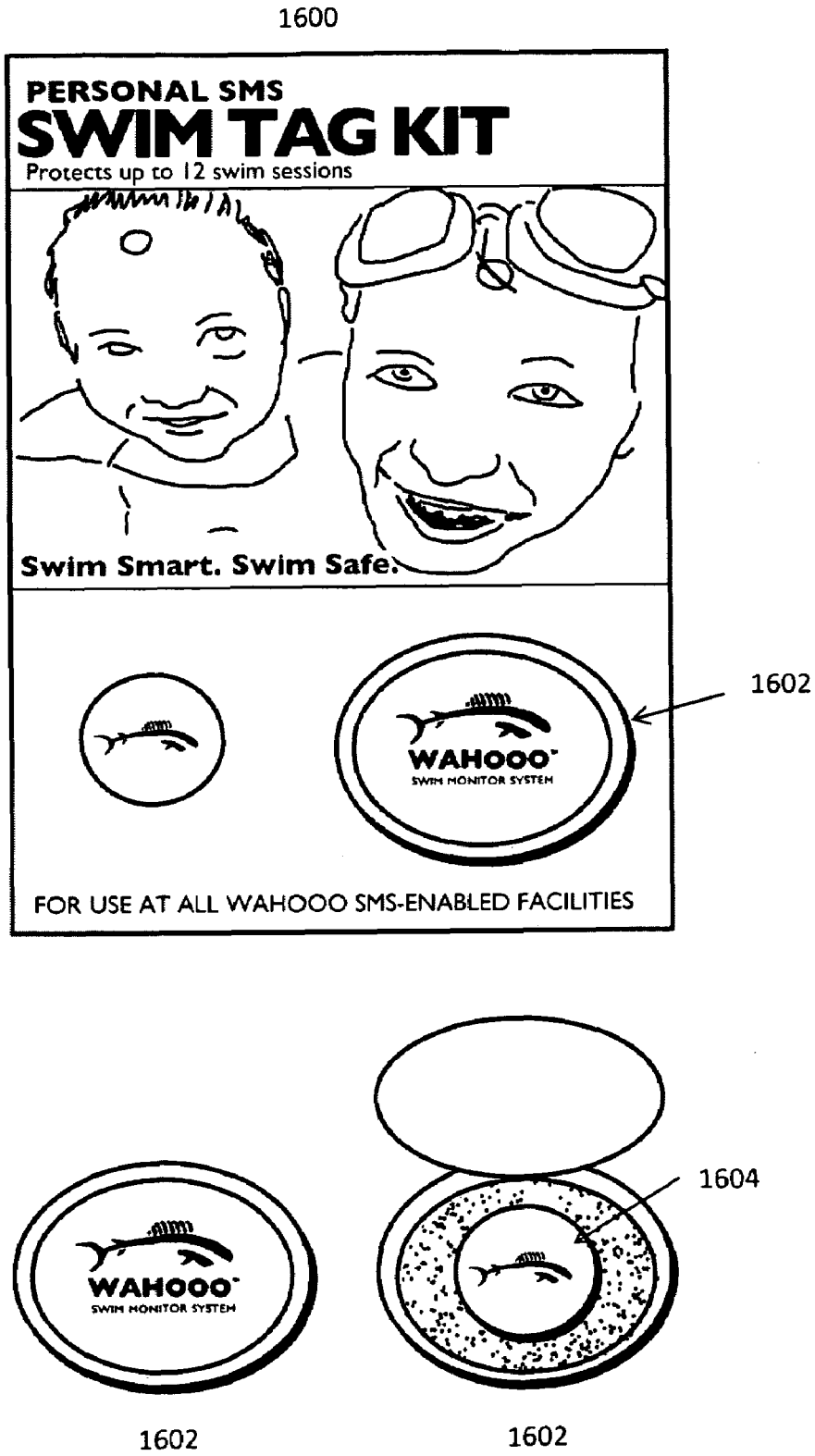
FIG. 16 is a top view of an alternative exemplary means for packaging Tags for retail sale.

FIG. 16 illustrates alternative packaging for a single Tag 1604. The single Tag is packaged in a hinged container 1602 and the hinged container is mounted on a retailing card 1600.

Refurbishing Tags

Figure 17:
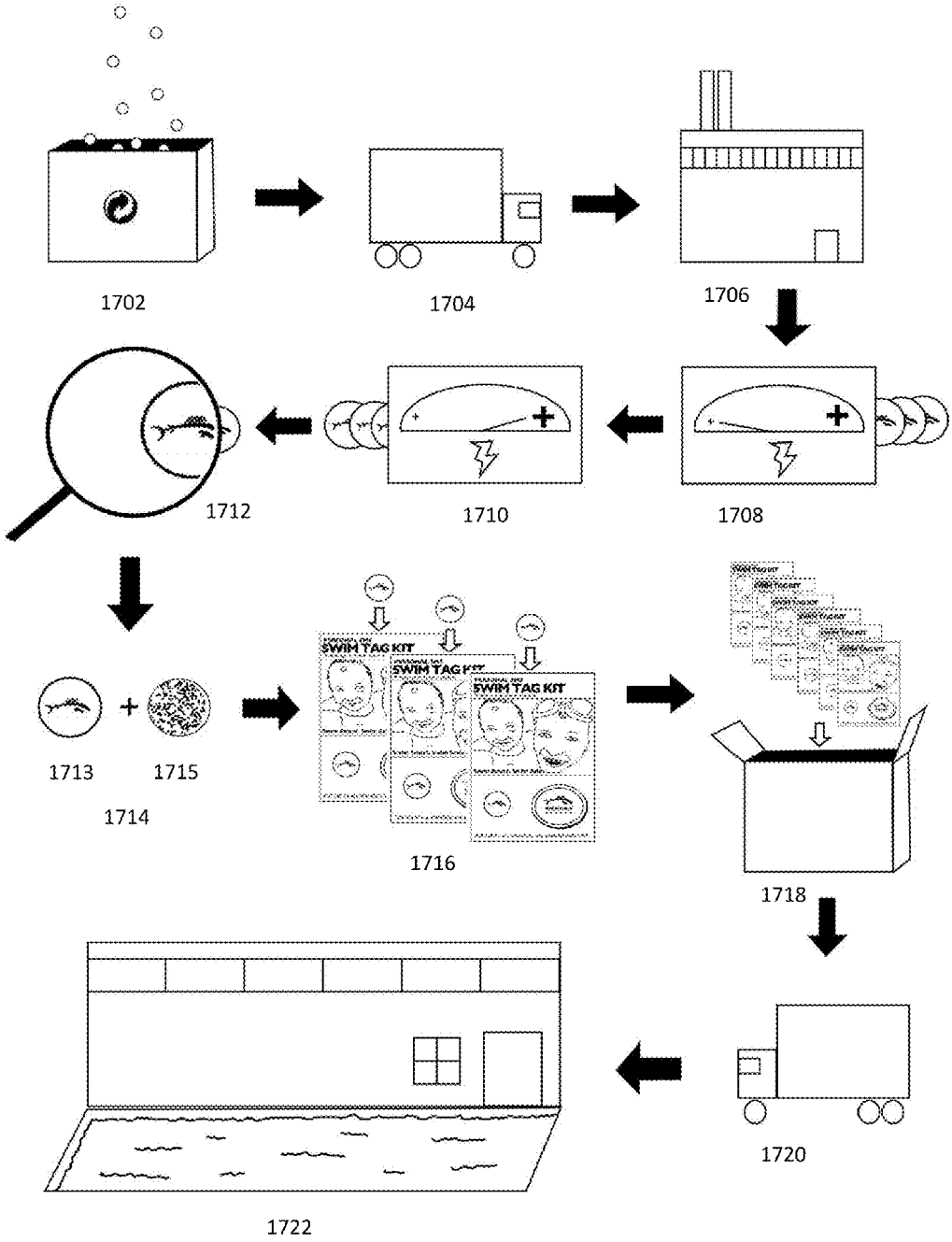
FIG. 17 illustrates a method for refurbishing Tags.

The Tags may be recycled. FIG. 17 illustrates a suitable refurbishing process. Used Tags are collected 1702 and shipped 1704 to a refurbishing facility 1706. The Tags are cleaned, tested 1708, recharged 1710, and inspected 1712. New adhesive 1715 is applied 1714 to the Tags 1713 and the Tags are packaged 1716, crated 1718 and shipped 1720 to an end user 1722.

Alternative Tag Technologies

Figure 18:
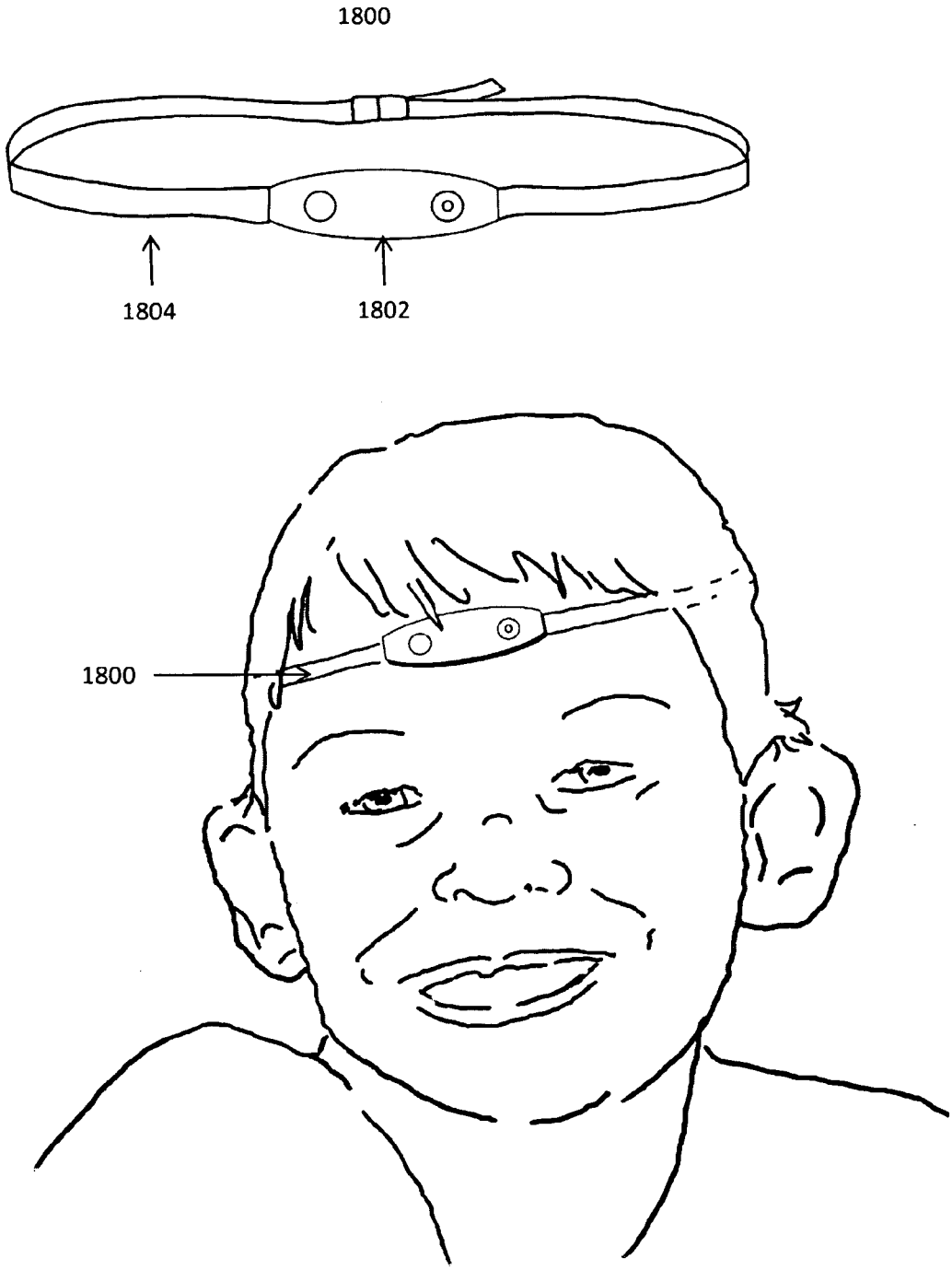
FIG. 18 illustrates a means for mounting Tags on a swimmer's head using an elastic band.

FIG. 18 illustrates an alternative mounting technology for a Tag. The Tag 1802 is provides with an adjustable elastic strap 1804. The assembly 1800 is then worn around the head of a swimmer.

Figure 19A:
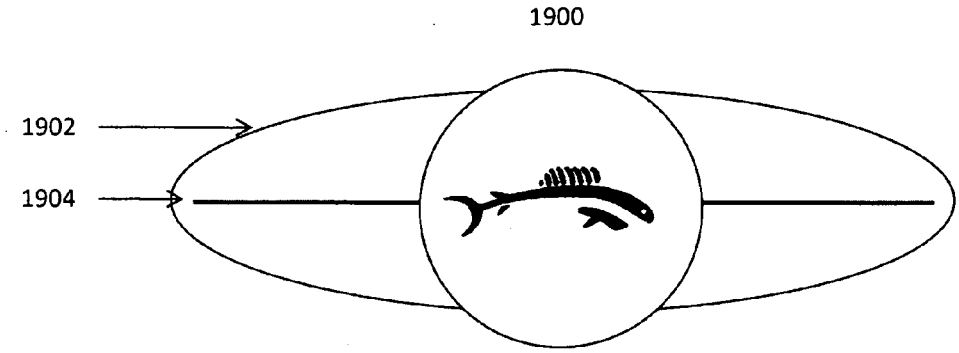
FIG. 19 illustrates a means for mounting Tags on a swimmer's head using adhesive "wings".
Figure 19B:
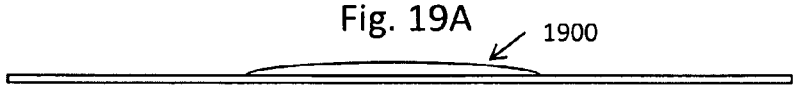
Figure 19C:
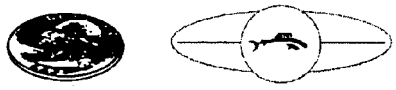
Figure 19D:
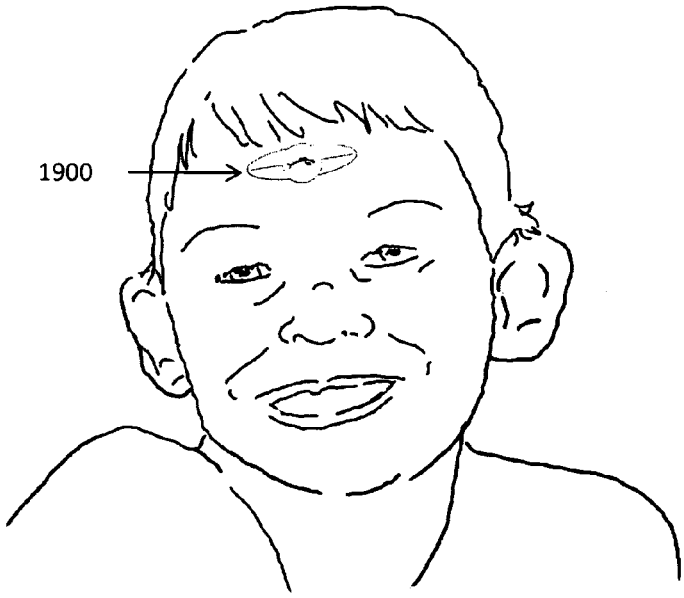

FIGS. 19A to 19D illustrates an adhesive bandage type of mounting. A Tag 1900 is provided with flexible adhesive wings 1902. The assembly is then adhered to the head of a swimmer. FIG. 19A shows a top view; FIG. 19B shows a side view; FIG. 19C shows a size comparison with a US quarter; and FIG. 19D shows the Tag mounted on a swimmer's head.

This configuration has the advantage of providing a convenient means for mounting a radio antenna 1904 on a Tag. The antenna facilitates an alternative means for determining how long a person's head has been underwater.

Figure 20:
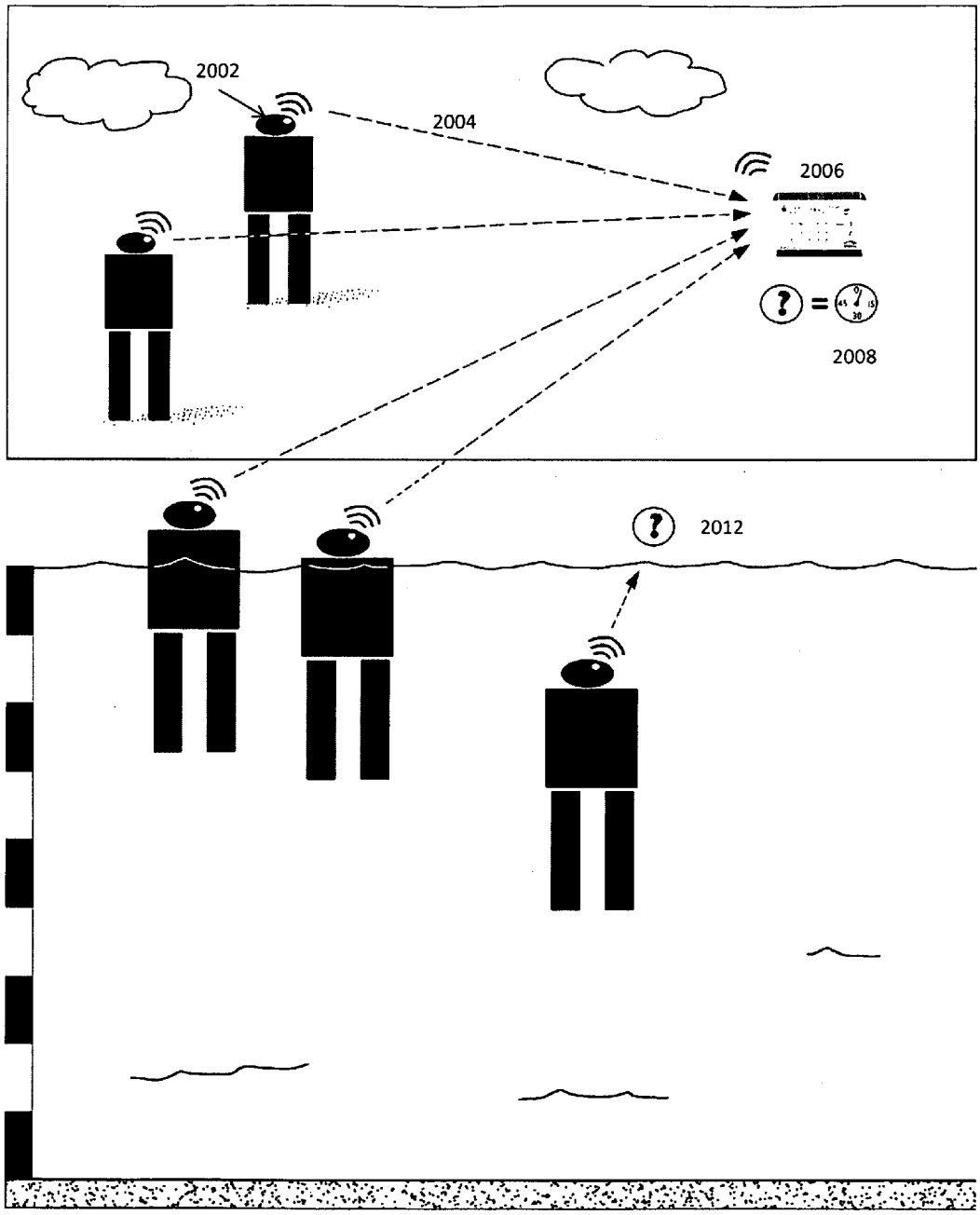
FIG. 20 is an illustration of an alternative means for determining how long a swimmer's head has been below water using the blockage of radio transmissions.

FIG. 20 shows a radio means for determining how long a person's head has been in water. A swimmer 2002 has a Tag mounted on his or her head. The Tag emits a constant or pulsed radio signal 2004, along with identifying information to a control station 2006. The control station keeps track of all Tags. When a person goes swimming and their head goes below water, the signal is blocked 2012 by water. The control station determines that a particular Tag is no longer above water and a timer 2008 is started. If the timer reaches a certain threshold, then a Yellow Alert or a Red Alarm may be signaled.

This system is advantageous at beaches where large distances can separate swimmers and where mounting and positioning of sonar based Swim Monitor Units may be difficult.

Figure 21A:
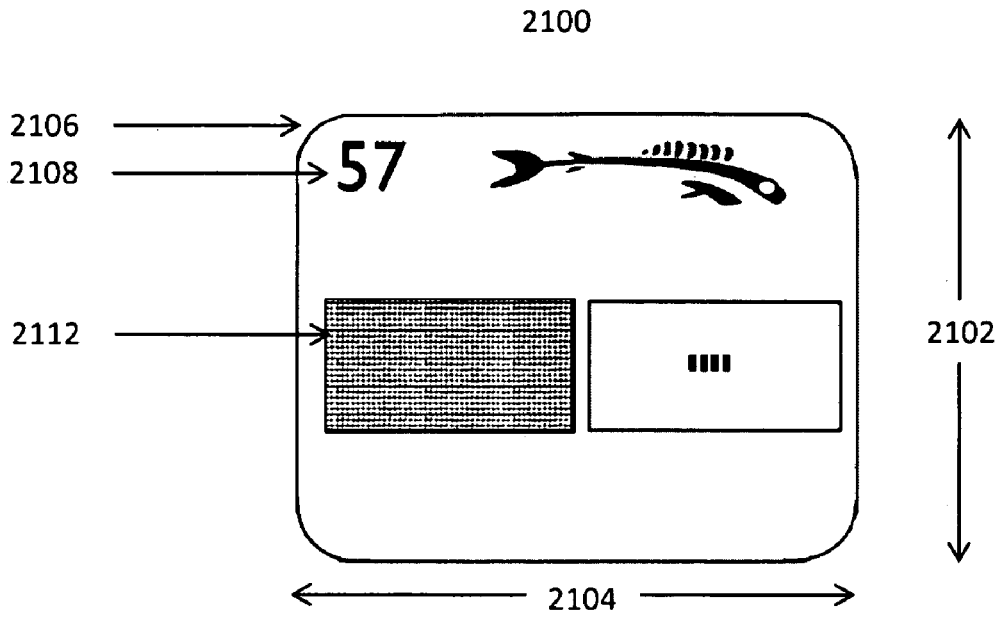
FIGS. 21A-21C are illustrations of a hip mounted Tag.
Figure 21B:
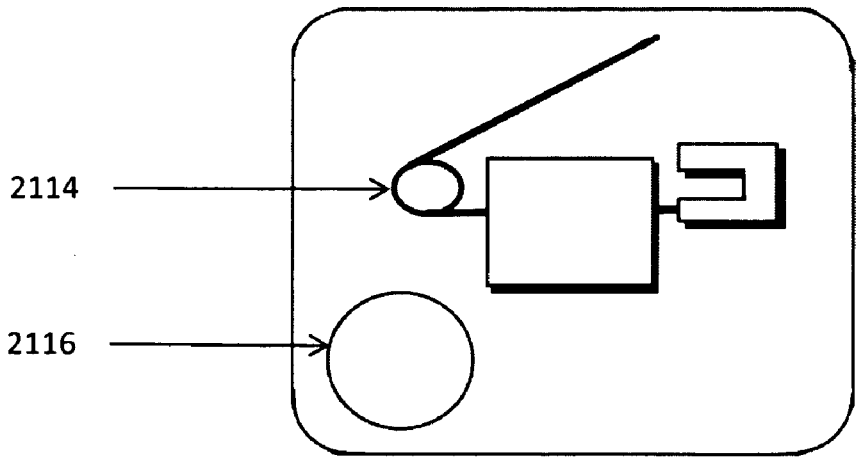
Figure 21C:
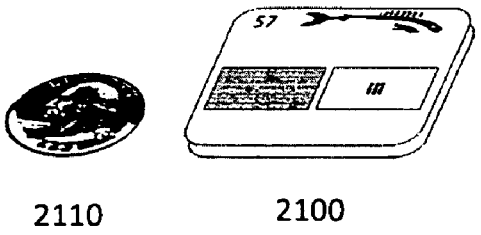

FIGS. 21A-21C illustrate a hip mounted Tag design 2100. FIG. 21A shows a top view; FIG. 21B shows a bottom view; and FIG. 21C shows a perspective view with a size comparison to a US quarter 2110.

This Tag is larger than the coin size sonar based Tag discussed with reference to FIG. 11C. The size may be 6 cm (2102) by 7 cm (2104). The maximum dimension may be 10 cm. The corners may be rounded 2106 to avoid snagging on clothes. The larger size facilitates the incorporation of larger indicia 2108 and strobe lights 2112. Mounting means, such as a safety pin 2114 may be provided to removably attach the Tag to clothes and a pressure sensor 2116 may be provided.

Figure 22:
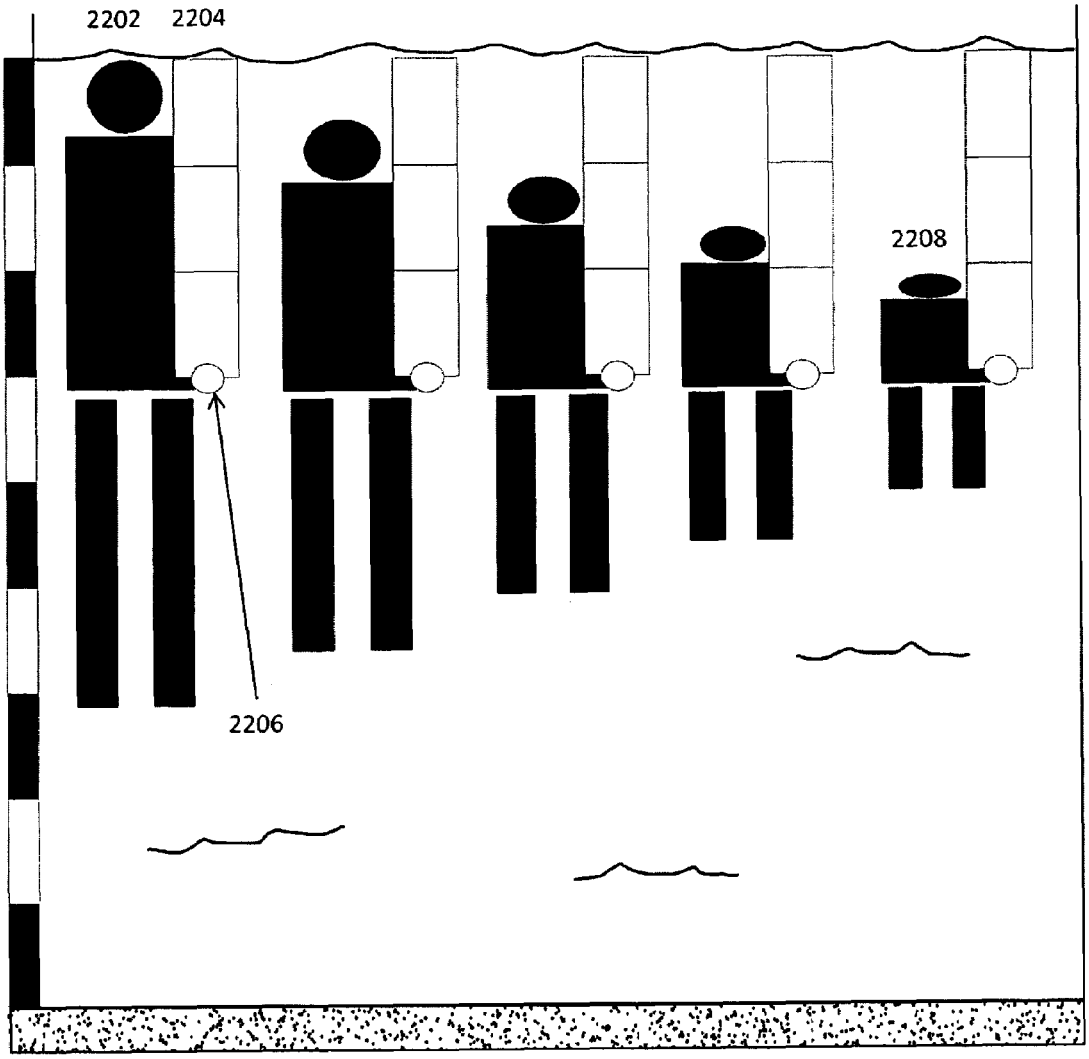
FIG. 22 illustrates the functionality of a hip mounted Tag.

FIG. 22 shows how a hip mounted Tag would work. The Tag 2206 is mounted on a swimmer 2202. When the swimmer's hips are more than one meter 2204 below the surface of the water, a sensor of depth, such as a water pressure sensor, triggers a timer. If the timer runs for the duration of a Yellow Alert or a Red Alarm, the Tag sends a sonar signal to a Swim Monitor Unit. They system is functional for both tall persons and short persons 2208.

Figure 29:
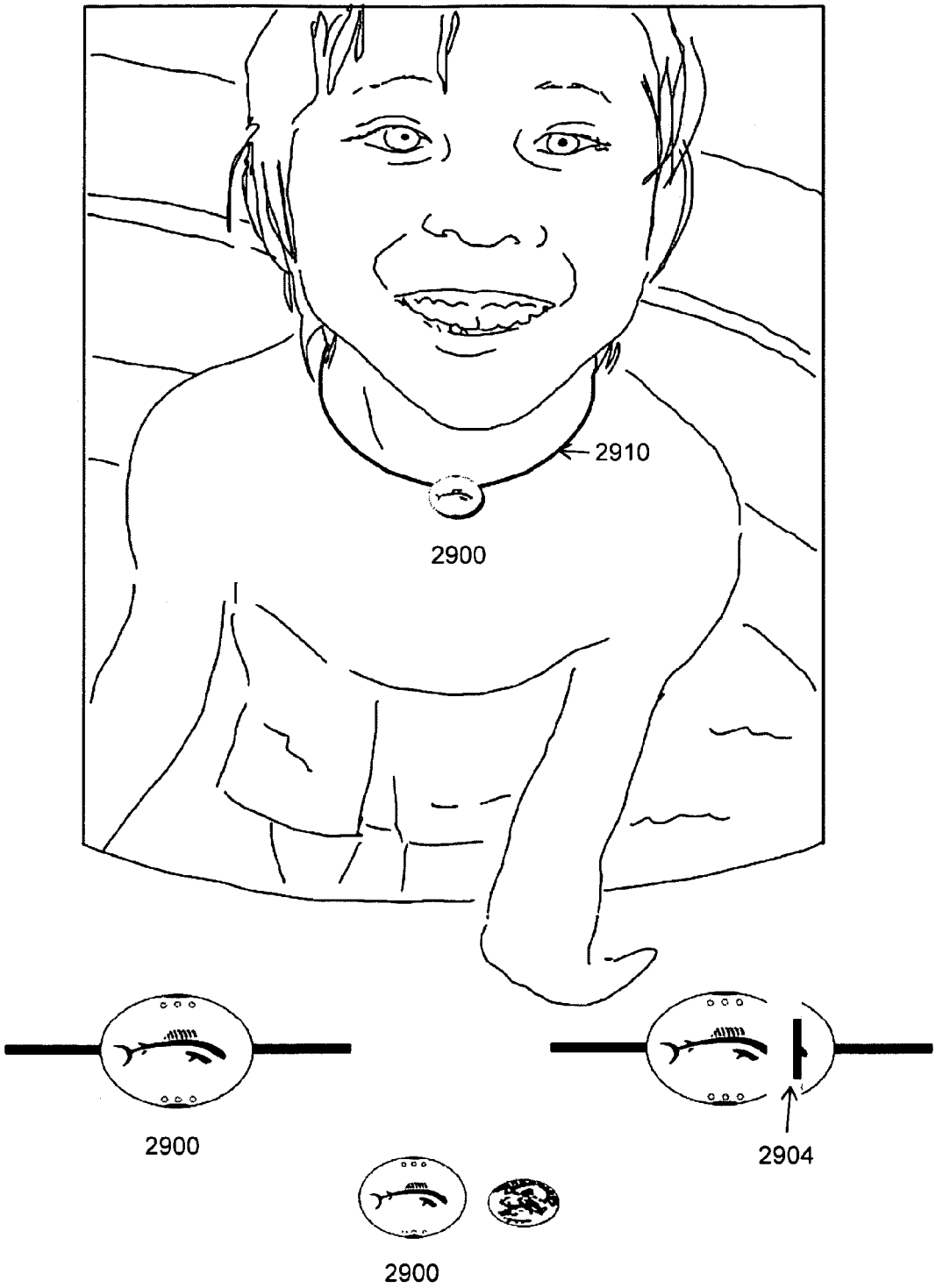
FIG. 29 is an illustration of a neck mounted Tag.

Skipping ahead to FIG. 29, FIG. 29 illustrates a Tag 2900 mounted on a necklace 2910. The Tag comprises a magnetic latch or mechanical latch 2904 to allow it to be easily put on and removed. The Tag may comprise a water emersion sensor and/or a water depth sensor. The Tag may, for example be set to sound an alarm when the depth is more than 30 cm for a given period of time.

Figure 30:
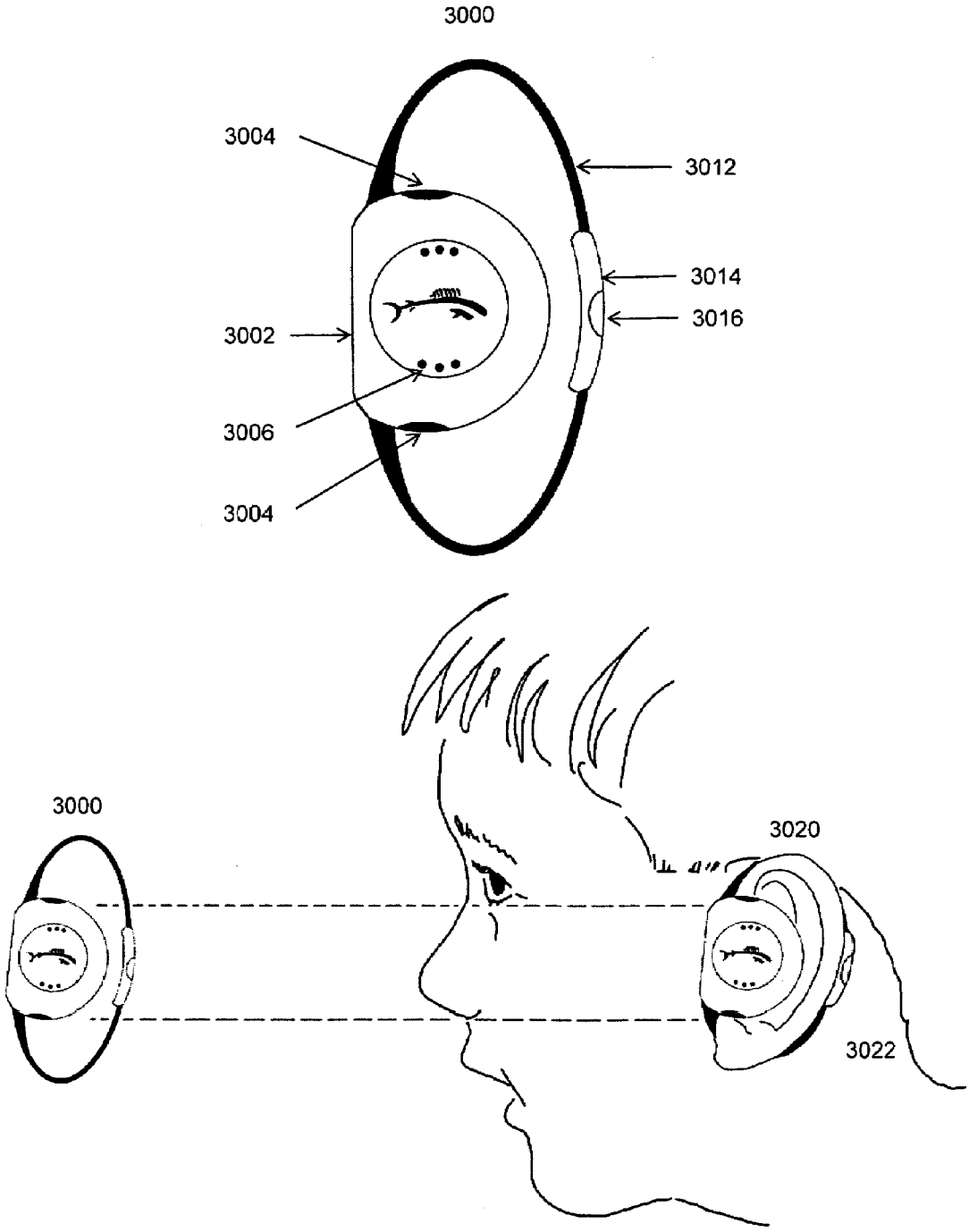
FIG. 30 is an illustration of an ear mounted Tag.

FIG. 30 illustrates a Tag 3000 that can be mounted on a swimmer's ear 3020. The Tag comprises a sensing unit 3002 and a band 3012. The sensing unit may comprise electrical contacts 3004 for sensing immersion in water and/or a pressure sensor for detecting immersion at depths greater than a predetermined amount, such as 30 cm. The sensing unit may also comprise LEDs 3006.

The band 3012 may comprise a cushion 3014 as well as a means 3016 to adjust the length.

A similar Tag without the band may also be mounted in the hollow 3022 behind a swimmer's ear by using a moldable waxy mounting compound.

Figure 31:
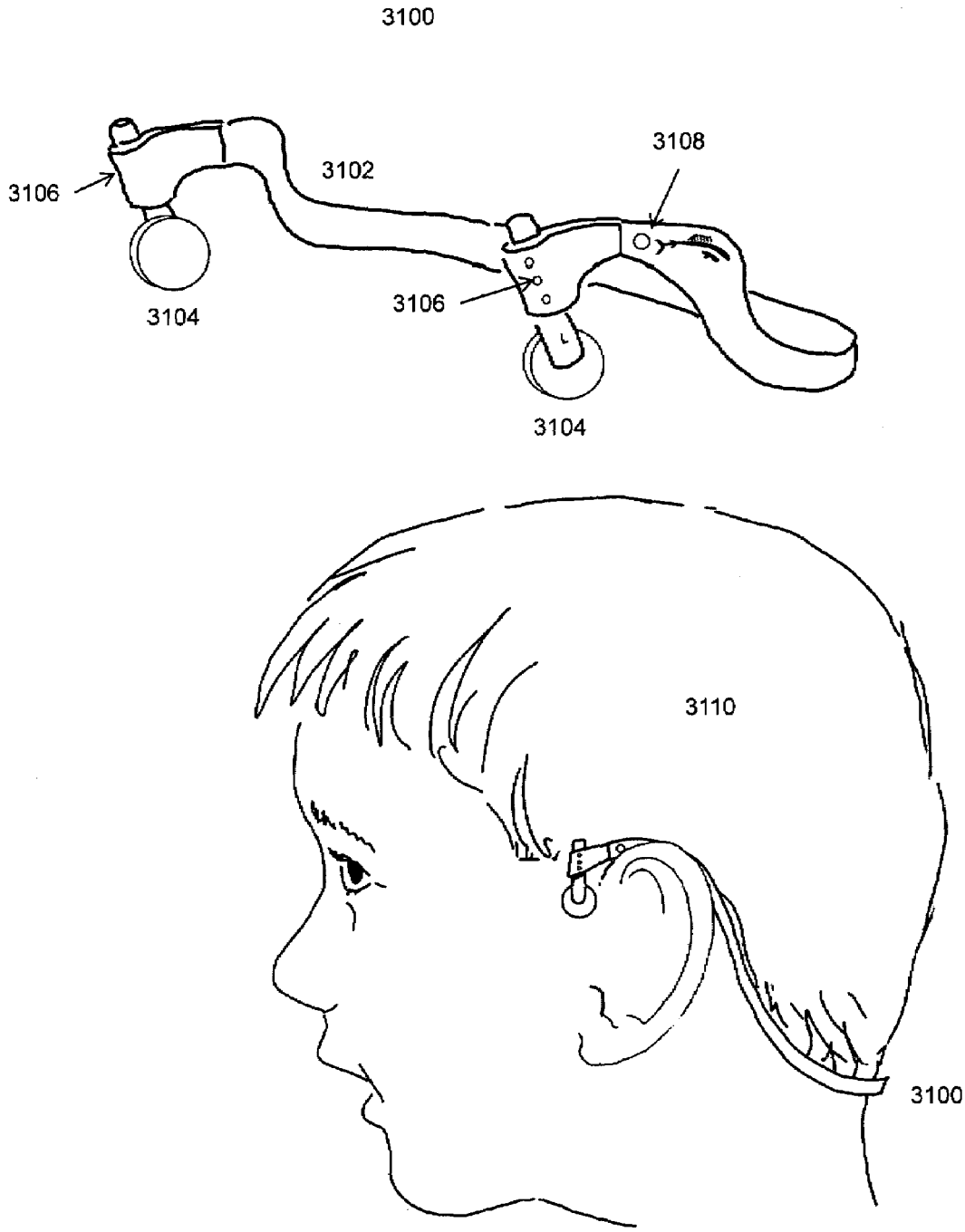
FIG. 31 is an illustration of a neck mounted Tag.

FIG. 31 illustrates a Tag 3100 that is in the form of a stiff but flexible open neck band. The Tag comprises a strap 3102 and pads 3104. The electronics of the Tag can be built into the strap. Electrical contacts 3106 are built in to each end of the strap. Thus, both sides of a swimmers head must be underwater to start the submersion timer. The strap is stiff enough to hold the band onto a swimmer's head 3110, but flexible enough to be removed by a person of ordinary strength. The Tag may further comprise one or more LEDs 3108.

Figure 32:
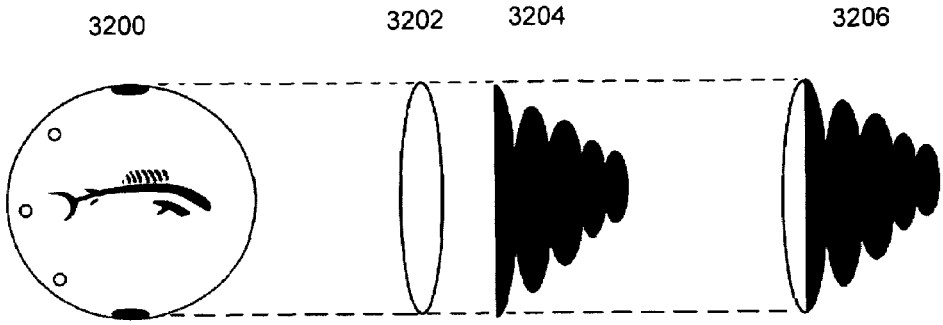
FIG. 32 is an illustration of an alternative ear mounted Tag.
Figure 32:
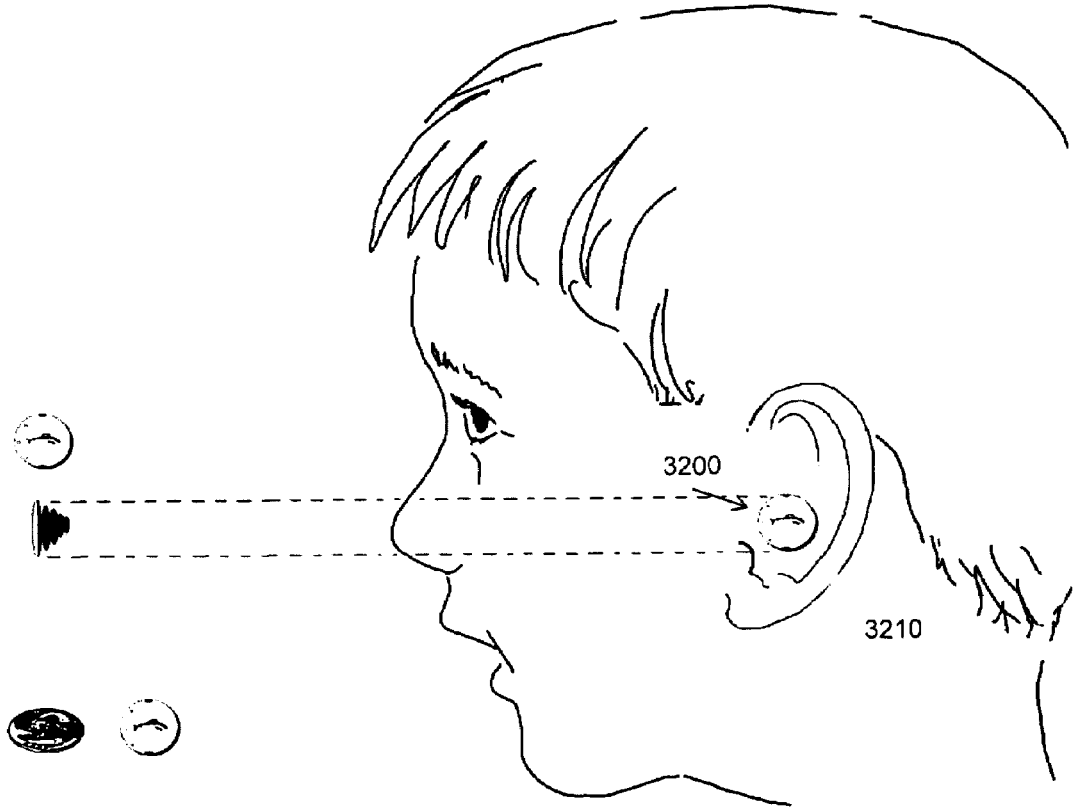

FIG. 32 illustrates a Tag 3200 that is mounted on an ear plug. The electronics 3202 are mounted on an elastomeric (e.g. silicone rubber) ear plug 3204 to form a final assembly 3206. This is then mounted in a swimmer's ear 3210. The ear plug may be disposable and the mounting may be mechanical by, for example, a lip (not shown) built into the plug.

Swim Monitor Unit

Figure 23A:
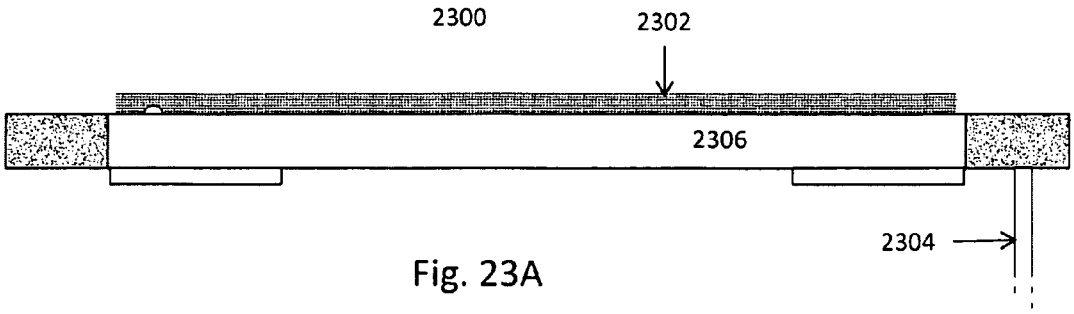
FIGS. 23A-23C illustrate an exemplary annunciation unit portion of a Swim Monitor Unit.
Figure 23B:
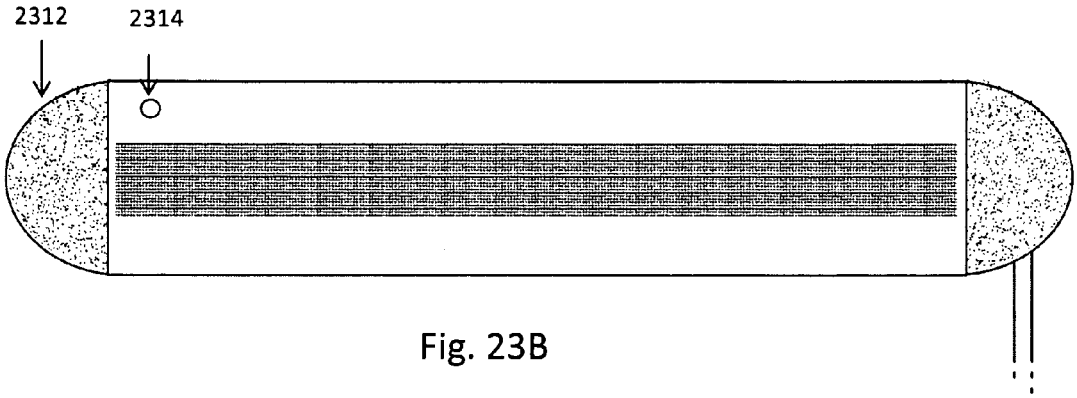
Figure 23C:
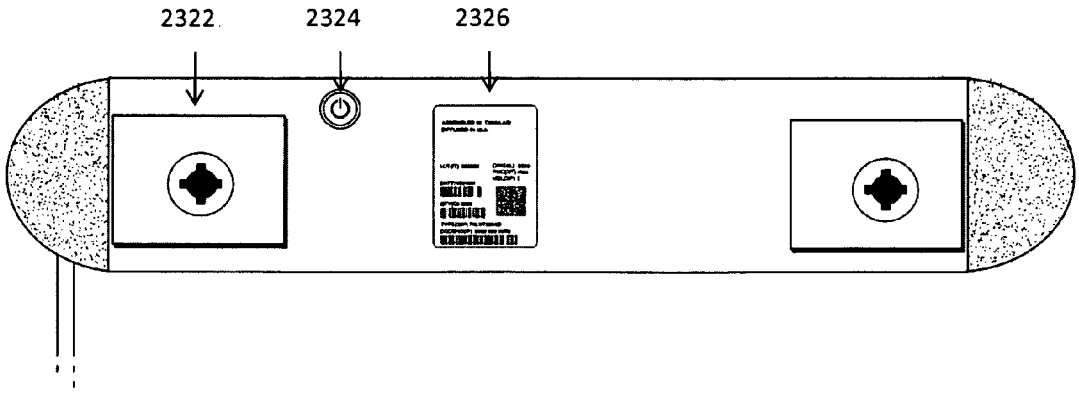

Referring back to FIG. 23, a swim monitor unit comprises an annunciation unit, connector cable and hydrophone unit. FIGS. 23A, 23B and 23C illustrate a side, top, and bottom view of an exemplary annunciation unit 2300. Referring to FIG. 23A, the annunciation unit comprises a strobe light 2302 for indicating alarm status, a connector cable 2304 for connecting to the submerged hydrophone, and associated electronics 2306 for amplifying and processing the ultrasonic signals received from the Tags.

Referring to FIG. 23B, the annunciation unit further comprises a removable rechargeable battery 2312, and an LED 2314, to indicate that it is working.

Referring to FIG. 23C, the annunciation unit further comprises mounting means 2322, a locking cover 2324 and indicia 2326 indicating product information.

Figure 24:
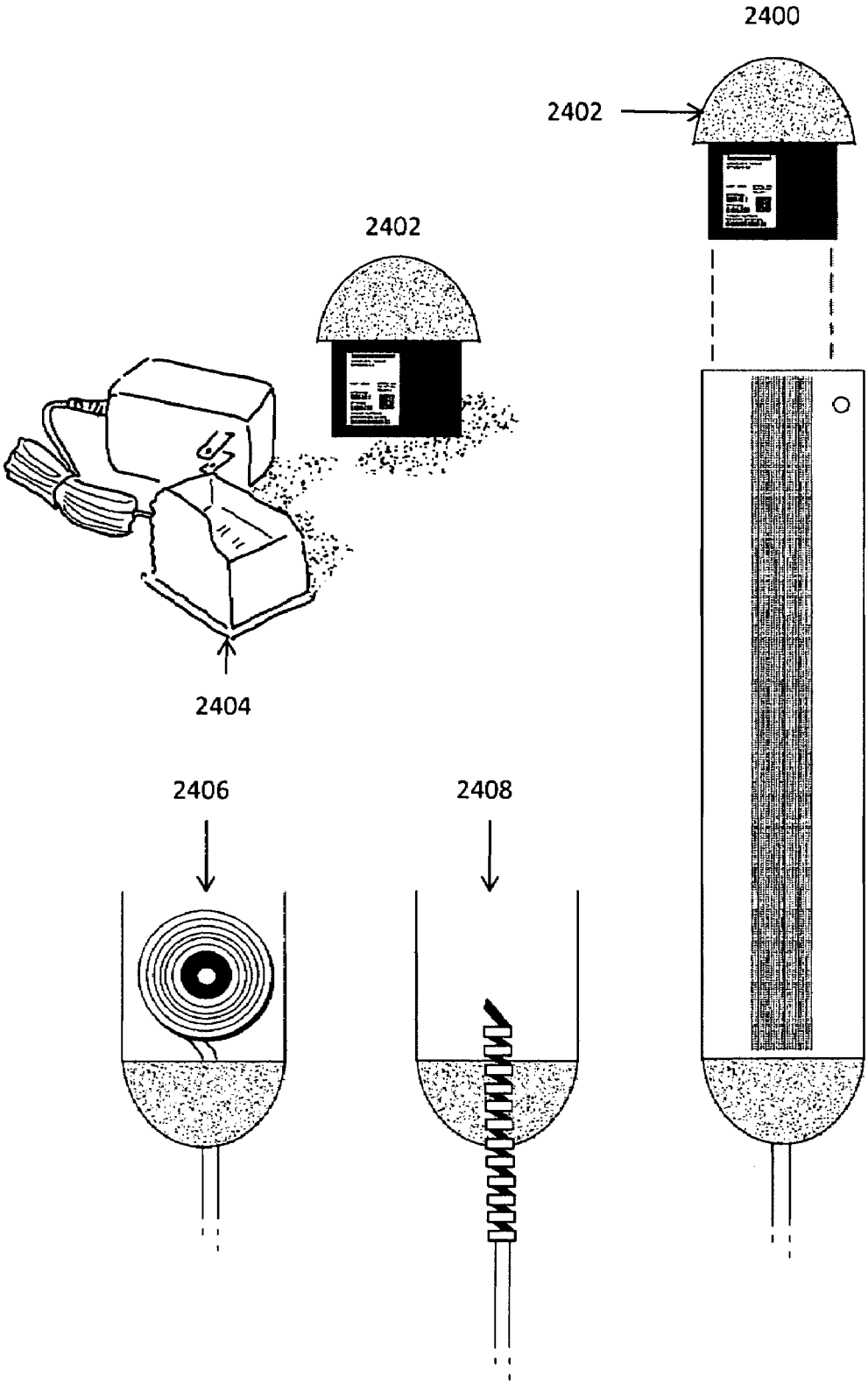
FIG. 24 illustrates means for recharging the battery of an annunciation unit and alternative means for storing a connecting cable.

FIG. 24 illustrates other features of an annunciation unit 2400. The rechargeable battery 2402 is removable and may be placed in a recharger 2404 to recharge. The connector cable may be stored in a retractable reel 2406 or expandable coil 2408.

Figure 25A:
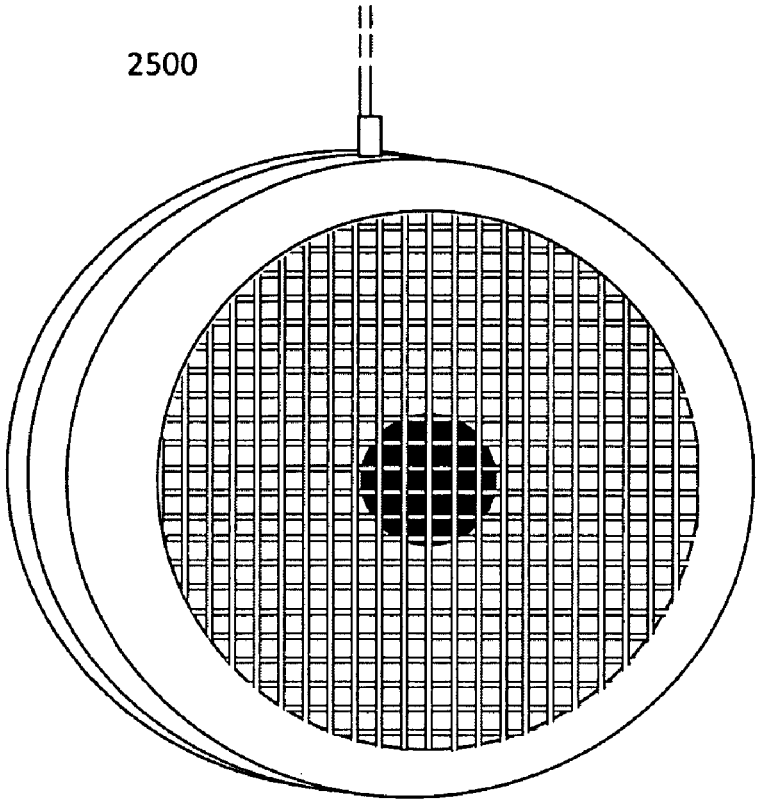
FIGS. 25A-25B illustrate an exemplary hydrophone unit portion of a Swim Monitor Unit.
Figure 25B:
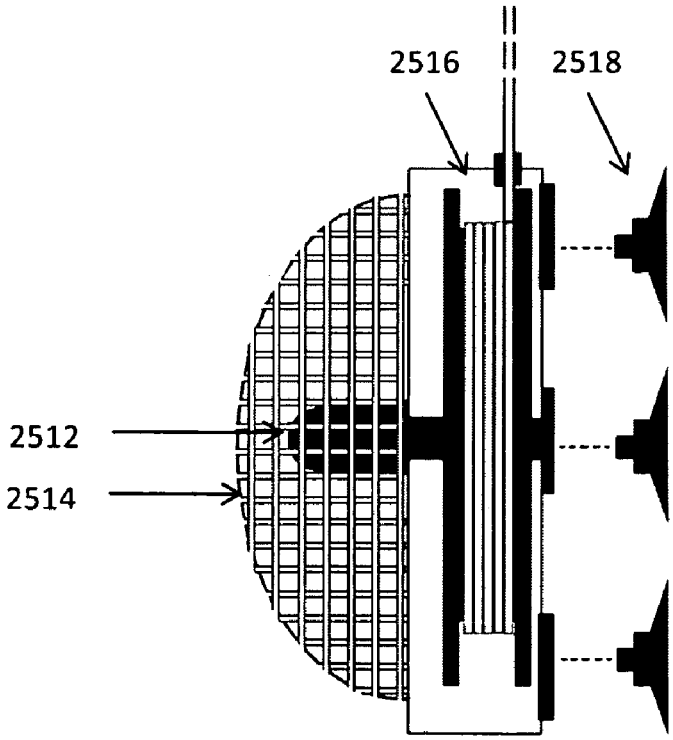

FIGS. 25A-25B illustrate an exemplary hydrophone unit. FIG. 25A shows a perspective top view of the hydrophone unit 2500; and FIG. 25B shows a side view of the hydrophone unit.

Referring to FIG. 25B, the hydrophone unit comprises a hydrophone 2512 for receiving ultrasonic signals from Tags; a protective cage 2514 to protect the hydrophone unit from, inter alia, swimmers hands and feet, a retractable coil 2516 for storing excess connector cable, and mounting means, such as suction cups 2518 for adhering the hydrophone unit to the wall of a pool.

Suitable hydrophone units, such as an SUR-1 Submersible Ultrasonic Receiver, may be obtained from Sonotronics Inc. of Tucson Ariz. The SUR-1 is more fully described on web page "SUR-1 Submersible Ultrasonic Receiver", www-.sonotronics.com/html/products/receivers/sur.html. Said web page is incorporated herein by reference.

Suitable hydrophone units may have a bandpass of +/−6 kHz of the designed ultrasonic signal of the Tags. Thus if the Tags are designed to broadcast at about 70 kHz (e.g. 71.4 kHz), then the hydrophone would have a bandpass of 64 to 76 kHz. This relatively narrow bandpass helps filter out background noise.

Figure 26:
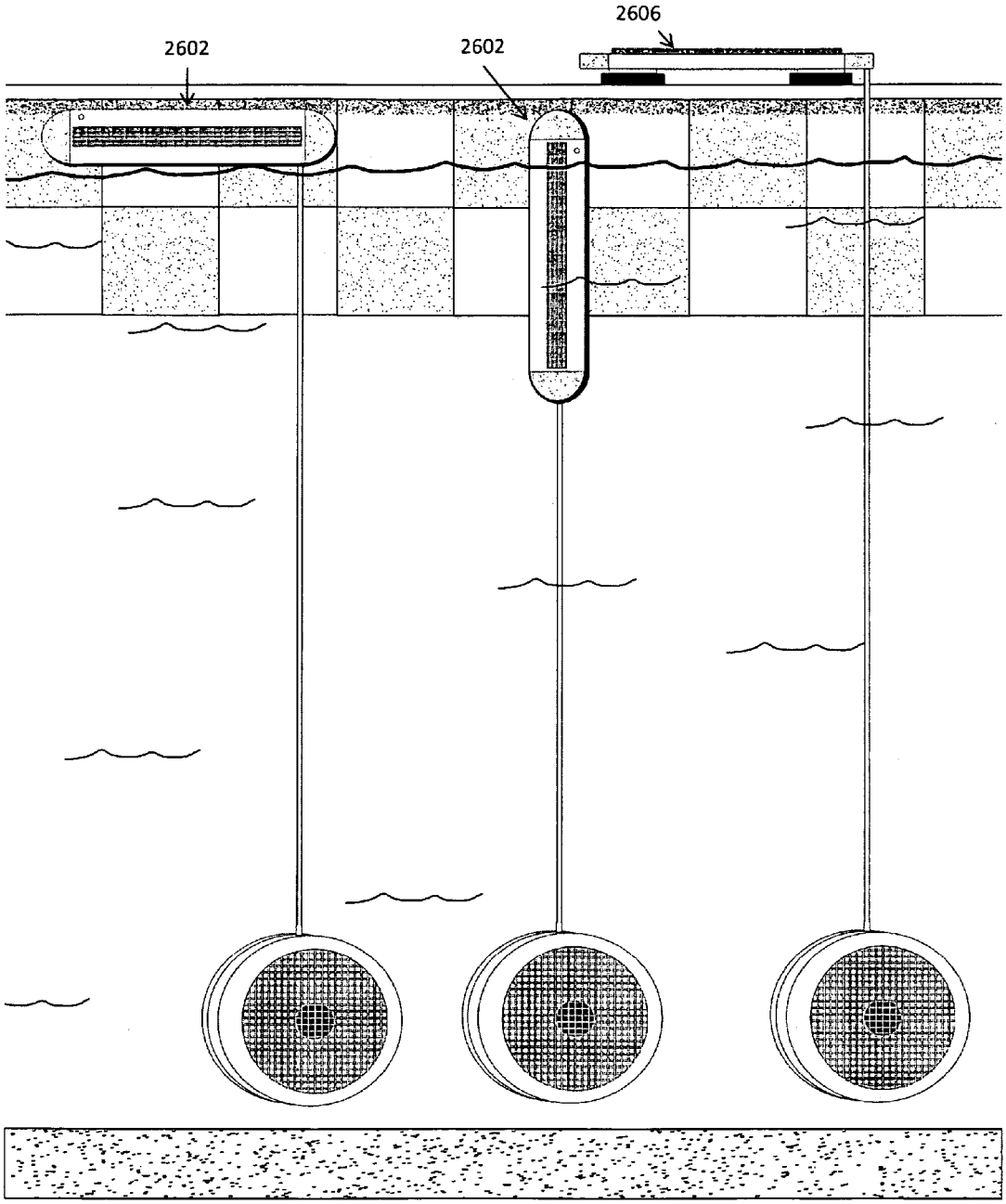
FIG. 26 illustrates alternative positioning of an annunciation unit.

FIG. 26 illustrates alternative mounting configurations for an annunciation unit. The annunciation unit may be mounted horizontally 2602 on the side of the pool. This has the advantage of having the strobe light entirely out of the water. Alternatively, the annunciation unit may be mounted vertically 2602 on the wall of the pool. This has the advantage of providing strobe light to the occupants of the pool that may be underwater at the time of an alarm. Alternatively, the annunciation unit may be mounted on the deck of the pool 2606. This has the advantage of being relatively easy to install.

Supervisory Control Unit

Figure 27:
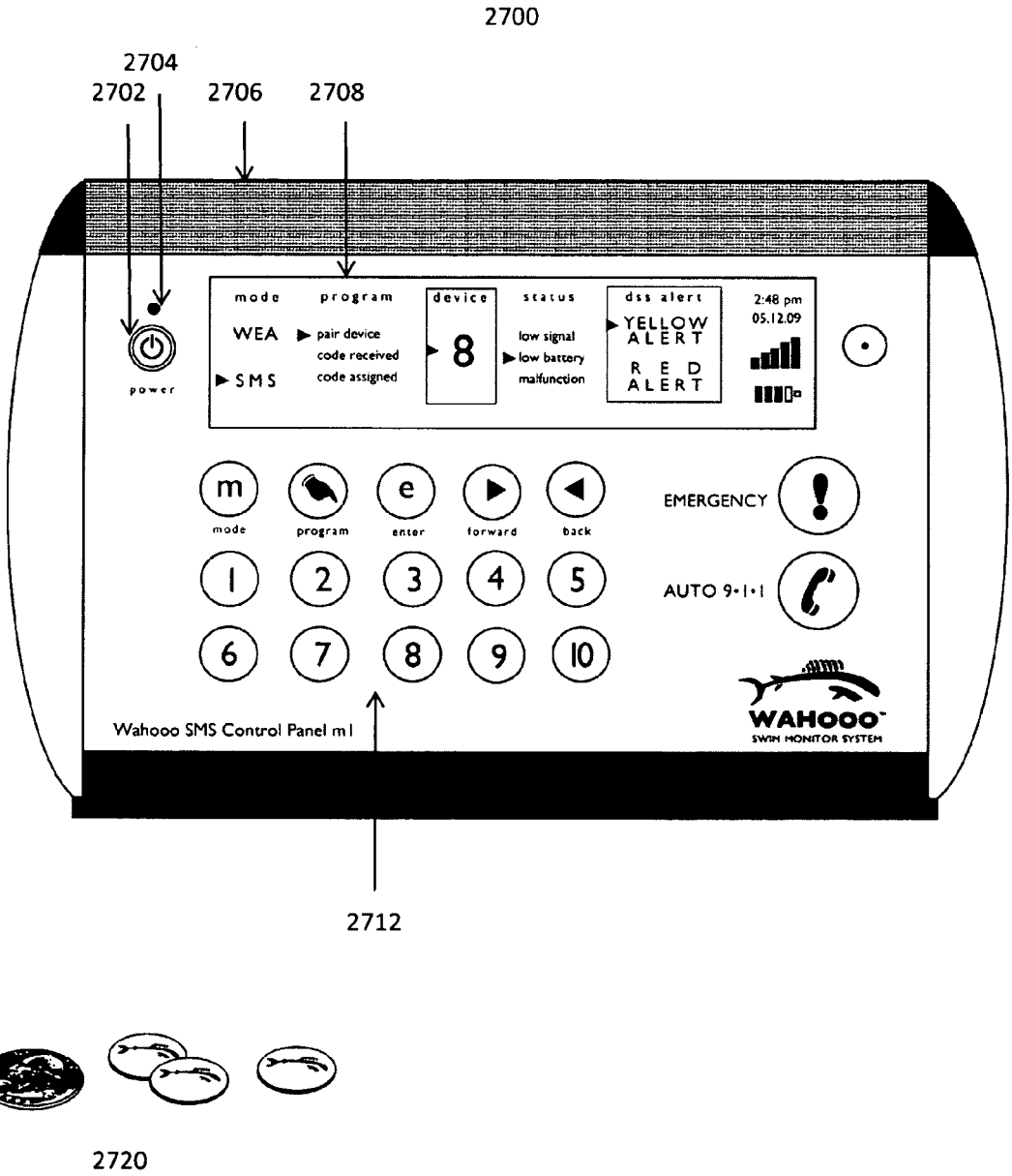
FIG. 27 illustrates an exemplary Control Unit.

FIG. 27 illustrates a face view of an exemplary Supervisory Control Unit 2700. The control unit comprises a power supply and electronics suitable for receiving signals from annunciation units and transmitting signals to alarms if necessary. The control unit further comprises a locking cover 2702, indicator LED 2704, strobe alarm light 2706, informational screen 2708 and touchpad 2712 for entering data and commands. A US quarter and Tags 2720 are shown to indicate scale.

Portable Reception Units

Figure 28:
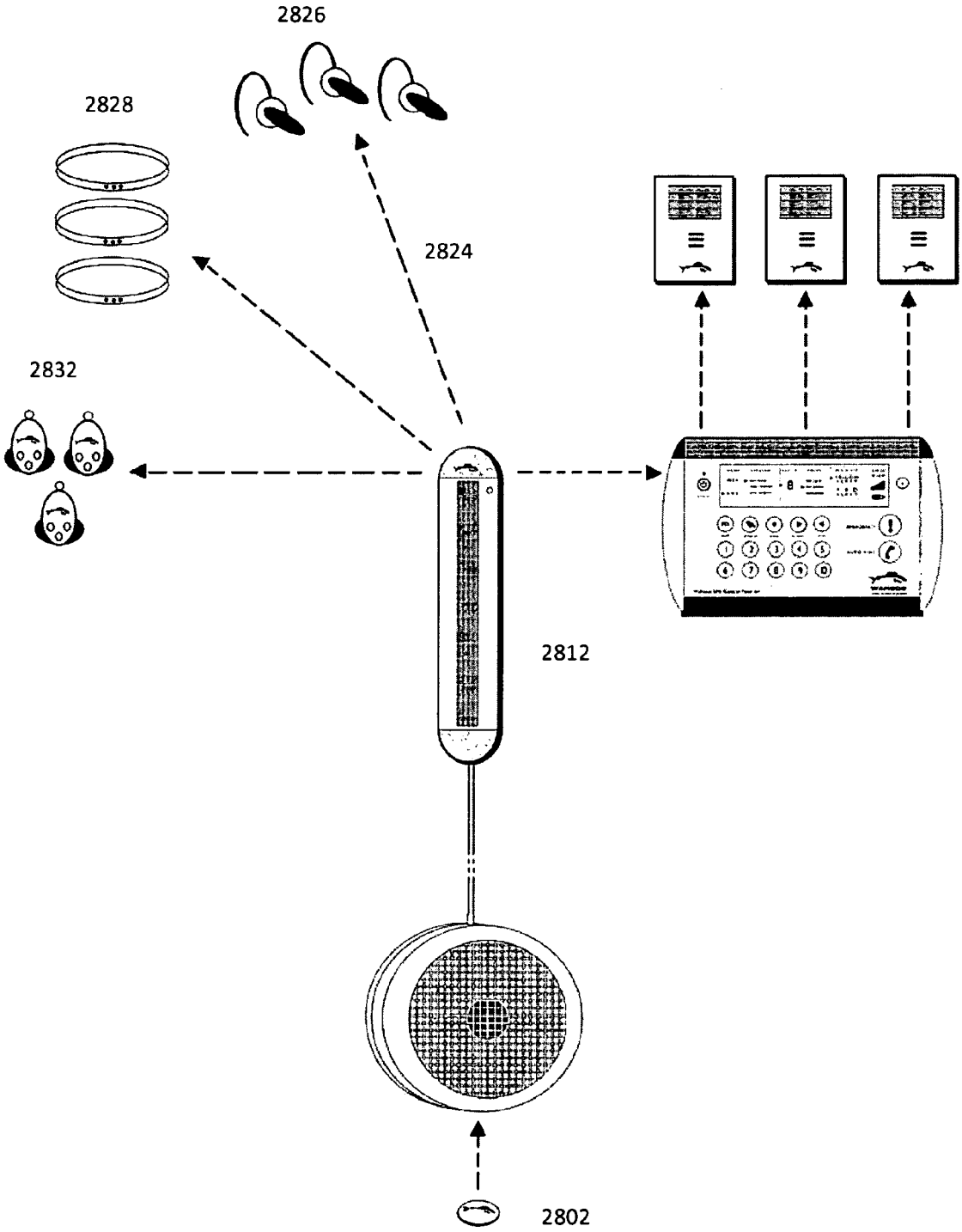
FIG. 28 illustrates means for an annunciation unit to communicate with supervisory units as well as the Control Unit.

FIG. 28 illustrates a number of alternative embodiments of portable reception units that may be worn by a lifeguard or other supervisory personnel. These include ear pieces 2826, bracelets 2828 and necklace tokens 2832. These designs may be both functional and have a certain aesthetic appeal.

As discussed above, the portable reception units would receive alarms 2824 from annunciation units 2812 after said alarms were received from Tags 2802 worn by swimmers. Communications may be by Bluetooth protocol.

Portable Family Systems

A completely portable embodiment is suitable for families visiting a body of water. It can consist of Tags, one or more portable battery powered SMU units, a battery powered Supervisory Control Unit and/or one or more Portable Reception Units. The Supervisory Control Unit may be configured like a briefcase or "boom box."

EXAMPLES

Example 1

A 25 meter long by 6 meter wide indoor pool was equipped with a swim monitor unit. The pool had a shallow end 1 meter in depth, and a deep end 3 meters in depth. The swim monitor unit was mounted at the middle of the wall of the deep end. The hydrophone rested on the bottom of the pool at a depth of 3 meters. The annunciation unit rested on the edge of the wall of the pool and communicated with a Supervisory Control Unit by radio transmission. The supervisory control unit was 3 meters from the annunciation unit.

A test swimmer entered the water at the midpoint of the pool and submersed a Tag in the water. The Tag was programmed to emit an ultrasonic Yellow Alert signal at 30 seconds and an ultrasonic Red Alarm signal at 45 seconds. After the Tag had been submersed for 30 seconds, the supervisory control unit sounded a Yellow Alert. The test swimmer then removed the Tag from the water and the Yellow Alert ceased.

The test swimmer then put the Tag in the water again. At 30 seconds, the Yellow Alert sounded. At 45 seconds the Red Alarm sounded. The test swimmer removed the Tag from the water and a supervisory person reset the control unit to silence the Red Alarm.

10 "interference swimmers" then entered the deep end of the pool, clung to the side walls of the pool and kicked the surface of the water vigorously to produce both bubbles and splashes. The interference swimmers were located between the test swimmer and the swim monitor unit. The test swimmer placed the Tag below the water, but at 30 seconds, no Yellow Alert sounded. The interference swimmers then stopped kicking and the Yellow Alert sounded.

A second swim monitor unit was then placed at the midpoint of the wall of the shallow end of the pool behind the test swimmer. The hydrophone was placed on the bottom of the pool at 1 meter depth. The annunciation unit was placed on the wall of the pool. The annunciation unit was about 28 meters from the control unit.

There were no interference swimmers between the test swimmer and the shallow end hydrophone. The interference swimmers then began kicking in the deep end and the test swimmer again placed the Tag below the surface of the water. A Yellow Alert sounded after the Tag had been submersed for 30 seconds.

Example 2

11 swimmers were equipped with Tags placed on their heads. The Tags were 20 mm in diameter, 5 mm thick and weighed about 3.3 gm each. Some Tags were mounted directly onto swimmers' heads using a removable waterproof medical-grade adhesive. They were positioned either on a forehead or behind an ear. Other Tags were mounted on swim goggles or held onto a forehead by an elastic band. The swimmers included children, teenagers and adults of both genders. The swimmers engaged in normal water activities at their own discretion for thirty minutes. All of the Tags stayed on the swimmers. None of swimmers expressed any discomfort with the Tags or expressed a desire to remove a Tag. The only unintentional Yellow Alert that sounded was when an adult swimmer with a Tag mounted behind her ear was resting against the side of the pool with her head inclined back. She was readily identified when the Yellow Alert sounded.

CONCLUSION

While particular embodiments of the present invention have been illustrated and described, it would be obvious to those skilled in the art that various other changes and modifications can be made without departing from the spirit and scope of the invention. Any of the aspects of the invention of the present invention found to offer advantages over the state of the art may be used separately or in any suitable combination to achieve some or all of the benefits of the invention disclosed herein.

The invention claimed is:

1. A method for increasing the safety of swimmers, said method comprising the steps of:

attaching a Swimmer Safety Tag to a swimmer, said Swimmer Safety Tag comprising means for:

i. sensing when said swimmer's nose and mouth is-are submersed in water below a predetermined depth;

ii. timing the duration of said submersion; and iii. transmitting an ultrasonic signal when said duration is greater than b. predetermined threshold;

c. monitoring for said signal;

d. transmitting an alarm to a supervisor when said monitoring detects said signal;

wherein said means for transmitting said ultrasonic signal comprises a piezoelectric transducer with a mechanical resonance frequency that is less than ultrasonic and an encapsulating layer bonded to said transducer such that said transducer effectively produces an ultrasonic signal when activated.

2. The method of claim 1 wherein said ultrasonic signal has a frequency of about 70 kHz.

3. The method of claim 1 wherein said monitoring is performed by a Swim Monitor Unit, said Swim Monitor Unit comprising:

a. a hydrophone located under water; and b. an annunciation unit located at least partially out of water wherein said annunciation unit comprises means for transmitting said alarm to said supervisor via an RF signal.

4. The method of claim 3 where wherein said hydrophone is located near the bottom of said water.

5. The method of claim 3 wherein said monitoring is performed by two or more Swim Monitor Units.

6. The method of claim 1 wherein said step of transmitting said alarm to said supervisor comprises the steps of:

a. Transmitting an RF signal to a Supervisory Control Unit; and b. Transmitting a digital signal to a portable reception unit, said portable reception unit being mounted on said supervisor's wrist.

7. The method of claim 6 wherein said RF signal is at a frequency of about 433 MHz.

8. The method of claim 6 wherein said digital signal at least partially employs Bluetooth technology.

9. The method of claim 1 wherein said Swimmer Safety Tag has a weight of 10 gm or less in air.

10. The method of claim 1 wherein said sensing comprises the steps of:

a. measuring the electrical conductivity between two contacts; and b. initiating said timing when said conductivity indicates that said two contacts are submersed in water;

wherein said contacts are each on the opposite side of said swimmer's head.

11. The method of claim 1 wherein said sensing comprises the steps of:

a. measuring pressure; and b. initiating said timing when said pressure is greater than a predetermined pressure threshold.

12. The method of claim 11 wherein said predetermined pressure threshold is about 30 cm of water column.

13. The method of claim 1 wherein said Swimmer Safety Tag is mounted on the head of said swimmer.

14. The method of claim 1 wherein said Swimmer Safety Tag is mounted at or below the waist of said swimmer.

15. The method of claim 1 wherein said step of monitoring is at least in part performed by electronics which are battery powered such that said electronics are portable.

16. A system for increasing the safety of swimmers, said system comprising:

a Swimmer Safety Tag, said Swimmer Safety Tag comprising means for:

i. sensing when said swimmer's nose and mouth is-are submersed in water below a predetermined depth;

ii. timing the duration of said submersion; and iii. transmitting an ultrasonic signal when said duration is greater than a predetermined threshold; and b. a monitor, said monitor comprising means for:

i. detecting said signal; and ii. transmitting an alarm to a supervisor when said monitor detects said signal;

wherein said means for transmitting said ultrasonic signal comprises a piezoelectric transducer with a mechanical resonance frequency that is less than ultrasonic and an encapsulating layer bonded to said transducer such that said transducer effectively produces an ultrasonic signal when activated.

17. The system of claim 16 wherein said Tag further comprises a microprocessor and wherein said ultrasonic signal has a frequency of about 70 kHz which represents an even multiple of the clock speed of said microprocessor.

18. The system of claim 16 wherein said monitoring is a Swim Monitor Unit, said Swim Monitor Unit comprising:

a. a hydrophone; and b. an annunciation unit, wherein said annunciation unit comprises means for transmitting said alarm to said supervisor via an RF signal.

19. The system of claim 18 wherein said Swim Monitor Unit further comprises a connecting cable, wherein said connecting cable:

a. has a length of at least 3 meters; and b. is attached at one end to said hydrophone and at another end to said annunciation unit such that an electrical signal can be transmitted therebetween.

20. The system of claim 18 wherein said system comprises two or more Swim Monitor Units.

21. The system of claim 16 wherein said system further comprises a Supervisory Control Unit and a portable reception unit and wherein said monitor comprises:

a. means for transmitting an RF signal to said Supervisory Control Unit; and b. means for transmitting a digital signal to said portable reception unit, said portable reception unit comprising means to be mounted on said supervisor.

22. The system of claim 21 wherein said RF signal is at a frequency of about 433 MHz.

23. The system of claim 21 wherein said digital signal at least partially employs Bluetooth technology.

24. The system of claim 16 wherein said Swimmer Safety Tag has a weight of 10 gm or less in air.

25. The system of claim 16 wherein said Swimmer Safety Tag comprises means for:

a. measuring the electrical conductivity between two contacts; and b. initiating said timing when said conductivity indicates that said two contacts are submersed in water.

26. The system of claim 16 wherein said Swimmer Safety Tag comprises means for:

a. measuring pressure; and b. initiating said timing when said pressure is greater than a predetermined pressure threshold.

27. The system of claim 26 wherein said predetermined pressure threshold is about 30 cm of water column.

28. The system of claim 16 wherein said Swimmer Safety Tag comprises means for removably mounting on the head of a swimmer.

29. The system of claim 16 wherein said Swimmer Safety Tag comprises means for removably mounting at or below the waist of said swimmer.

30. The system of claim 16 wherein said monitor is battery powered such that said monitor is portable.

31. A Tag for increasing the safety of a swimmer, said Tag comprising:

a. means for mounting said Tag on said swimmer;

b. means for detecting immersion in water;

c. means for timing immersion in water; and d. means for transmitting a first ultrasonic signal in the event that the immersion time exceeds a first predetermined threshold value; wherein said means for transmitting said first ultrasonic signal comprises a piezoelectric transducer with a mechanical resonance frequency that is less than ultrasonic and an encapsulating layer bonded to said transducer such that said transducer effectively produces an ultrasonic signal when activated.

32. The Tag of claim 31 wherein said Tag has a weight in air of less than 10 gm.

33. The Tag of claim 31 which further comprises means for transmitting a second ultrasonic signal in the event that said immersion time exceeds a second predetermined threshold value, wherein said second predetermined threshold is greater than said first predetermined threshold such that said second ultrasonic signal corresponds to a "Red Alarm" which indicates that said swimmer may be in immediate danger of drowning.

34. The Tag of claim 33 wherein said first ultrasonic signal and said second ultrasonic signal are broadcast at the same frequency and wherein said first ultrasonic signal comprises first pulses broadcast for a first duration and at a first rate and said second ultrasonic signal comprises second pulses broadcast for a second duration at a second rate and wherein said first duration is less than one half of said second duration.

35. The Tag of claim 34 wherein said first rate and said second rate are less than or equal to about once every 2 seconds.

36. The Tag of claim 31 wherein said first ultrasonic signal has a frequency of about 70 kHz.

37. The Tag of claim 31 wherein said first ultrasonic signal has a frequency in the range of 30 to 100 KHz.

38. The Tag of claim 31 wherein said Tag has a diameter that is less than or equal to 20 mm, said Tag has a thickness that is less than or equal to 5 mm and said Tag has a weight that is less than or equal to about 3 gm.

39. The Tag of claim 31 which further comprises a microprocessor and a battery, said microprocessor being programmed to generate ultrasonic pings while in a resting state, said pings each having a duration in the range of 5 ms to 30 ms and a repetition rate of at least once every 2.2 seconds when said immersion time is less than said first predetermined threshold value such that said battery has a life of at least 30 days of submersions when said battery has a power rating of about 74 milliamp-hours.

40. The Tag of claim 39 which further comprises means for transmitting a sonic signal in the event that said battery has 20% or less than its full charge available.

41. The Tag of claim 31 wherein said means for mounting said Tag on said swimmer comprises an adhesive.

42. The Tag of claim 31 wherein a logo is displayed on the surface of said Tag and wherein a light is incorporated into said logo and wherein means are provided to flash said light when said Tag is mounted on said swimmer.

43. The Tag of claim 31 wherein said Tag further comprises:

a. means for sensing whether or not said Tag is mounted on a swimmer; and b. means for transmitting a sonic signal in the event that said Tag is not mounted on said swimmer;

wherein said means for sensing whether or not said Tag is mounted on said swimmer comprises two electrodes that will be electrically connected by water if said Tag should be removed from said swimmer and immersed in said water.

44. The Tag of claim 31 wherein said means for mounting said Tag on said swimmer comprises means for mounting said Tag on the forehead of said swimmer, wherein said means for mounting comprises an adhesive.

45. The Tag of claim 31 wherein said means for detecting the immersion of said Tag into said water comprises two electrical contacts which close an electrical circuit upon immersion into water and wherein said two electrical contacts are each on the opposite side of said swimmer's head when said Tag is mounted on said swimmer.

46. The Tag of claim 31 wherein said means for detecting immersion of said Tag into said water comprises a radio transmitter broadcasting at a radio frequency wherein said frequency is blocked by water.

47. The Tag of claim 31 which further comprises an open neck band.

48. The Tag of claim 31 which further comprises means for mounting said Tag in at least one ear canal of said swimmer.

* * * * *